US006183923B1

(12) United States Patent
Kato et al.

(10) Patent No.: US 6,183,923 B1
(45) Date of Patent: Feb. 6, 2001

(54) LITHOGRAPHIC PRINTING PLATE PRECURSOR AND METHOD FOR PREPARING LITHOGRAPHIC PRINTING PLATE USING THE SAME

(75) Inventors: Eiichi Kato; Seishi Kasai, both of Shizuoka (JP)

(73) Assignee: Fuji Photo Film Co., Ltd., Kanagawa (JP)

( * ) Notice: Under 35 U.S.C. 154(b), the term of this patent shall be extended for 0 days.

(21) Appl. No.: 09/251,880

(22) Filed: Feb. 17, 1999

(30) Foreign Application Priority Data

Feb. 20, 1998 (JP) ..... 10-039197
Feb. 26, 1998 (JP) ..... 10-045612
Sep. 29, 1998 (JP) ..... 10-275721
Sep. 30, 1998 (JP) ..... 10-278250

(51) Int. Cl.[7] ..... G03G 5/00; G03G 13/01
(52) U.S. Cl. ..... 430/96; 430/49; 430/56; 428/195; 428/328
(58) Field of Search ..... 430/49, 56, 96; 428/195, 328

(56) References Cited

U.S. PATENT DOCUMENTS 5,677,098 * 10/1997 Nakayama et al. ..... 430/95
5,770,340 * 6/1998 Nakayama et al. ..... 430/95
6,019,045 * 2/2000 Kato et al. ..... 101/466
6,106,984 * 8/2000 Kato et al. ..... 430/49

OTHER PUBLICATIONS

Miall et al, A New Dictionary of Chemistry, Longman Group Limited, London 1968, p. 26.*
Grant, Hackh's Chemical Dictionary, McGraw–Hill Book Company, Inc., N.Y., N.Y. 1944, pp. 771–772).*

* cited by examiner

*Primary Examiner*—Janet Baxter
*Assistant Examiner*—Barbara Gilmore
(74) *Attorney, Agent, or Firm*—Reed Smith LLP

(57) ABSTRACT

A lithographic printing plate precursor is disclosed, comprising a water-resistant support having provided thereon an image-receiving layer, wherein the image-receiving layer comprises anatase-type titanium oxide grains and a binder resin comprising a complex composed of an organometallic polymer and an organic polymer containing at least one member selected from the group consisting of an amido bond, a urethane bond, a ureido bond and a hydroxy group, the surface of the image-receiving layer has a contact angle with water of at least 25 degrees and the contact angle with water thereof is reduced to 15 degrees or below when it is irradiated with ultraviolet light, and further, a method for preparing the lithographic printing plate precursor and a method for preparing a lithographic printing plate by using the lithographic printing plate precursor are disclosed.

17 Claims, 2 Drawing Sheets

LITHOGRAPHIC PRINTING PLATE PRECURSOR AND METHOD FOR PREPARING LITHOGRAPHIC PRINTING PLATE USING THE SAME

FIELD OF THE INVENTION

The present invention relates to a lithographic printing plate precursor and a method for preparing a lithographic printing plate using the printing plate precursor and, more particularly, to a lithographic printing plate precursor capable of providing a printing plate which enables to print a great number of printed matter having clear images free from background stains and a method for preparing a lithographic printing plate using the printing plate precursor.

BACKGROUND OF THE INVENTION

Lithographic printing plate precursors which are used mainly in the filed of small-scale commercial printing include (1) a direct drawing type printing plate precursor having a hydrophilic image-receiving layer provided on a water-resistant support, (2) a printing plate precursor having provided on a water-resistant support a lipophilic image-receiving layer comprising zinc oxide, which is converted into a printing plate by undergoing direct drawing image formation and then desensitizing treatment with a desensitizing solution to render the non-image area hydrophilic, (3) a printing plate precursor of an electrophotographic light-sensitive material having provided on a water-resistant support a photoconductive layer comprising photoconductive zinc oxide, which is converted into a printing plate by undergoing image formation and then desensitizing treatment with a desensitizing solution to render the non-image area hydrophilic, and (4) a printing plate precursor of a silver-halide photographic material having a silver halide emulsion layer provided on a water-resistant support.

With the development of office appliances and the expansion of office automation in recent years, it has been desired in the field of printing to adopt an offset printing system wherein a lithographic printing plate is directly prepared from the printing plate precursor of direct drawing type (the foregoing (1)) utilizing various image forming means, e.g., an electrophotographic printer, a heat-sensitive transfer printer or an ink jet printer without undergoing any other special treatment for conversion into the printing plate.

Further, another method for direct preparation of a printing plate wherein an electrophotographic printer is utilized has been proposed. More specifically, in an electronic editorial system wherein input, correction, editing, layout and pagination are performed by a continuous computer operation and the resulting image information is instantly transmitted into terminal plotters in distant places via a high-speed communication network or a communications satellite, an electrophotographic printer adaptable to digital signal input is used as the terminal plotter, and a printing plate is prepared directly from the output of the printer.

Recently, an ink jet recording method rapidly spreads because of its ability of low noise and high-speed printing.

With respect to the ink jet recording method, various ink jet systems, e.g., a so-called electric field controlling system in which ink is ejected utilizing electrostatic attraction, a so-called drop-on-demand system (pressure pulse system) in which ink is ejected utilizing an oscillation pressure of a piezoelectric element, and a so-called bubble (thermal) jet system in which ink is ejected utilizing a pressure developed by bubbles produced and grown by means of high thermal energy have been proposed, and these systems can provide images of high accuracy.

A conventional lithographic printing plate precursor of direct drawing type comprises a support, such as paper, having on one surface side an image-receiving layer which is a surface layer provided via an interlayer and on the other surface side a back layer. The interlayer and the backlayer are each composed of a water-soluble resin, such as PVA or starch, a water-dispersible resin, such as a synthetic resin emulsion, and a pigment. The image-receiving layer comprises an inorganic pigment, a water-soluble resin and a water resisting agent.

Examples of inorganic pigment used include kaolin, clay, talc, calcium carbonate, silica, titanium oxide, zinc oxide, barium sulfate and alumina.

Examples of water-soluble resin used include polyvinyl alcohol (PVA), modified PVA such as carboxylated PVA, starch and derivatives thereof, cellulose derivatives such as carboxymethyl cellulose and hydroxyethyl cellulose, casein, gelatin, polyvinyl pyrrolidone, vinyl acetate-crotonic acid copolymer, and styrene-maleic acid copolymer.

Examples of water resisting agent used include glyoxal, initial condensates of aminoplasts such as melamine-formaldehyde resin and urea-formaldehyde resin, modified polyamide resins such as methylolated polyamide resin, polyamide-polyamine-epichlorohydrin adduct, polyamide epichlorohydrin resin, and modified polyamide-polyimide resin.

In addition to the above described ingredients, it is known that a cross-linking catalyst such as ammonium chloride or a silane coupling agent can also be used.

However, for improving printing durability of a printing plate obtained by a conventional manner as described above, if the hydrophobicity of the printing plate is enhanced by adding a large amount of the water resisting agent or by using a hydrophobic resin, printing stains due to the decrease in hydrophilicity (affinity of the plate for water) occur although the press life is improved. On the contrary, the enhancement of hydrophilicity results in lowering of the water resistance to cause deterioration of press life.

In particular, when the printing plate is used under a temperature condition of 30° C. or more, it has a defect that the surface layer thereof is dissolved in dampening water used for offset printing to result in deterioration of press life and occurrence of printing stains. Moreover, since images are drawn directly on an image-receiving layer of a printing plate precursor with oil-based ink in the case of direct drawing type lithography, poor adhesion of the oil-based ink to the image-receiving layer causes separation of the oil-based ink from the image area during printing, thereby deteriorating the press life even if the occurrence of printing stains in the non-image area is prevented because of sufficient hydrophilicity. This problem does not yet come to a satisfactory solution.

With respect to the ink used for forming images on a conventional lithographic printing plate precursor of direct drawing type in accordance with an ink jet recording system, water-based ink which uses water as the main solvent and oil-based ink which uses an organic solvent as the main solvent are ordinarily employed.

However, the water-based ink has drawbacks of blurring the images on the printing plate precursor and causing a decrease of drawing speed due to slow drying. In order to overcome such drawbacks, a method of utilizing oil-based ink containing a nonaqueous solvent as a dispersion medium is disclosed in JP-A-54-117203 (the term "JP-A" as used herein means an "unexamined published Japanese patent application").

This method, however, is still insufficient, because image blurs are actually observed on the plate obtained, and further blurs are generated in printed matter upon printing. In addition, the number of printed matter obtained with the printing plate is on the order of several hundreds at the most, which is much lower than the desired level. Moreover, the ink has a problem of being apt to clog a nozzle for ejecting so fine ink droplets as to form images of high resolution.

In the ink jet recording system, the ink is usually passed through a filter and then ejected from a nozzle. Thus, this system tends to cause ejection troubles depending on various factors such that the nozzle or filter is liable to be clogged, the ink-fluidity changes with the lapse of time, and so on.

Such ink ejection troubles are caused by not only a water-based ink compositions but also an oil-based ink composition. For preventing the ink ejection troubles, various proposals have been made. For instance, for preventing the ink ejection troubles in the case of using an oil-based ink composition in the ink jet recording system of electric field controlling type, it is proposed that the viscosity and specific resistance of the ink composition are controlled as described in JP-A-49-50935. It is also proposed that the dielectric constant and specific resistance of a solvent used for the ink composition are controlled as described in JP-A-53-29808.

Further, as attempts to prevent clogging of the nozzle due to ordinary oil-based ink for a printer in the ink jet recording system, methods of improving dispersion stability of pigment particles (as described, e.g., in JP-A-4-25573, JP-A-5-25413, and JP-A-5-65443), methods of incorporating specific compounds into ink compositions (as described, e.g., in JP-A-3-79677, JP-A-3-64377, JP-A-4-202386, JP-A-7-109431) have been proposed.

However, even if any of the ink compositions according to those methods is used for image formation on a printing plate precursor, the images formed suffer from insufficiency of strength during printing, so the resulting lithographic printing plate cannot have a satisfactory press life.

On the other hand, in the case of adopting a platemaking method wherein images are formed on a printing plate precursor having a zinc oxide-containing image-receiving layer by an appropriate method and then the non-image area is treated with a desensitizing solution, the image on the printing plate and printed matter have good quality and a great number of printed matter having good quality can be provided. However, this method is accompanied with the complication in wet processing. Specifically, it is essential for the method to use the desensitizing solution in the course of platemaking and dampening water containing the same desensitizing component as the desensitizing solution at the time of printing. In addition, it occurs, though depends on printing ink used, that the component in the dampening water used has interaction with some component in the printing ink to tend to cause stains in the printed matter. Thus, this method has a problem of being unsuitable for color printing with a wide variety of printing inks.

In the field of digital adaptable electrophotographic printer, remarkable technical improvements have been made lately. For instance, reproduction of high resolution image have been achieved by an electrophotographic printer using fine dry toner having a particle size of 6 to 8 $\mu$m, and reproduction of highly accurate images with a high reproducibility have been achieved by an electrophotographic printer using liquid toner.

In a system of image formation on a printing plate precursor of direct drawing type by image transfer using, e.g., a laser printer of such a system as described above, therefore, it is required that both prevention of background stains in the non-image area after transfer and good image reproducibility in the image area be achieved to provide printed matter having clear images without background stains, in great numbers. Further, it is desired that printed matter having a wide variety of color images be easily obtained.

Furthermore, it is requested to simply carry out the desensitizing treatment for the non-image area in the preparation of printing plate.

SUMMARY OF THE INVENTION

The present invention aims to solve these problems accompanied with conventional methods for preparation of a printing plate.

Therefore, an object of the present invention is to provide a method for preparing a lithographic printing plate which can provide a great number of printed matter having clear images free from background stains and disappearance or distortion of images.

Another object of the present invention is to provide a lithographic printing plate precursor which forms by a dry process for desensitization a lithographic printing plate which can provide a great number of printed matter having clear images free from background stains even when various kinds of printing ink are used.

A further object of the present invention is to provide a method for preparing a lithographic printing plate by utilizing an electrophotographic recording system using a liquid toner or by utilizing an electrostatic attraction type ink jet recording system using oil-based ink, which can provide a great number of printed matter having clear images free from background stains and blurs.

A still further object of the present invention is to provide a method for preparing a lithographic printing plate by utilizing an ink jet recording system in which the ink jet recording is performed consistently stably even when it is repeatedly used and which forms a lithographic printing plate having an excellent press life.

Other objects of the present invention will become apparent from the following description.

It has been found that these objects of the present invention are attained by the following items (1) to (3):

(1) A lithographic printing plate precursor comprising a water-resistant support having provided thereon an image-receiving layer, wherein the image-receiving layer comprises anatase-type titanium oxide grains and a binder resin comprising a complex composed of an organometallic polymer and an organic polymer containing at least one member selected from the group consisting of an amido bond, a urethane bond, a ureido bond and a hydroxy group, the surface of the image-receiving layer has a contact angle with water of at least 25 degrees and the contact angle with water thereof is reduced to 15 degrees or below when it is irradiated with ultraviolet light.

(2) A method for preparing a lithographic printing plate comprising forming a colored toner image on an image-receiving layer of a lithographic printing plate precursor which comprises a water-resistant support having provided thereon the image-receiving layer comprising anatase-type titanium oxide grains and a binder resin comprising a complex composed of an organometallic polymer and an organic polymer containing at least one member selected from the group consisting of an amido bond, a urethane bond, a ureido bond and a hydroxy group, by utilizing an electrophotographic recording system and then irradiating the whole surface of the image-receiving layer with ultraviolet light to change the non-image area to a hydrophilic surface which does not receive printing ink.

(3) A method for preparing a lithographic printing plate comprising forming a colored image on an image-receiving layer of a lithographic printing plate precursor which comprises a water-resistant support having provided thereon the image-receiving layer comprising anatase-type titanium oxide grains and a binder resin comprising a complex composed of an organometallic polymer and an organic polymer containing at least one member selected from the group consisting of an amido bond, a urethane bond, a ureido bond and a hydroxy group, by utilizing an ink jet recording system and then irradiating the whole surface of the image-receiving layer with ultraviolet light to change the non-image area to a hydrophilic surface which does not receive printing ink.

BRIEF DESCRIPTION OF THE ACCOMPANYING DRAWINGS

Figure 1:
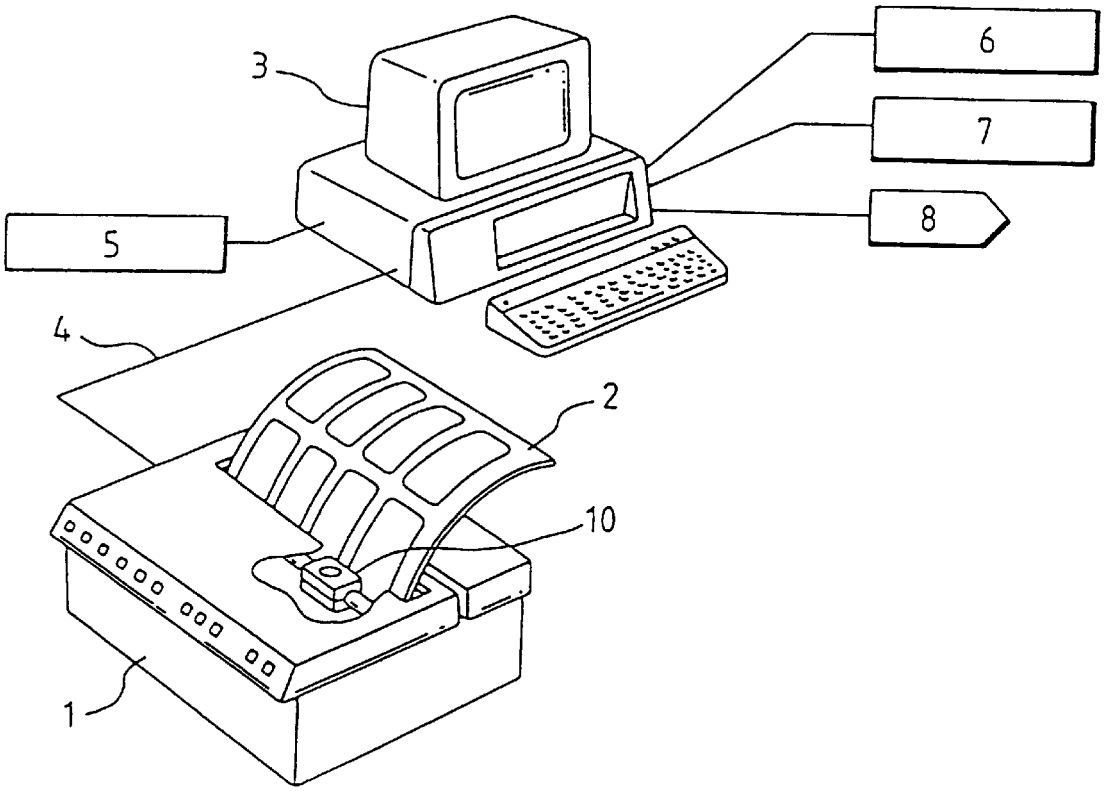
FIG. 1 is a schematic view showing an example of an apparatus system employed in the present invention.

In these figures, the numerals denote the following members respectively:

1, Ink jet recording apparatus

2, Lithographic printing plate precursor (Master)

3, Computer

4, Bus

5, Video camera

6, Hard disk

7, Floppy disk

8, Mouse

10, Head

10*a*, Ejection slit

10*b*, Ejection electrode

10*c*, Counter electrode

11, Oil-based ink

101, Upper unit

102, Lower unit

DETAILED DESCRIPTION OF THE INVENTION

The present invention is characterized in that colored images are formed on a lithographic printing plate precursor by an appropriate method and then the printing plate precursor is irradiated all over with ultraviolet light to render the non-image area hydrophilic, thereby preparing a lithographic printing plate. The lithographic printing plate precursor used in the present invention can ensure sufficient strength in the images formed thereon, and does not generate background stains on the non-image area thereof after water-receptive treatment. The resulting lithographic printing plate can provide a great number of printed matters having clear images.

The present invention also includes the following embodiments:

(1-1) The lithographic printing plate precursor as described in the item (1), wherein the image-receiving layer has a surface smoothness of at least 30 seconds/10 ml measured in the term of a Bekk smoothness.

(1-2) The lithographic printing plate precursor as described in the item (1), wherein the organometallic polymer is a polymer formed by a hydrolysis polymerization condensation reaction of at least one organometallic compound represented by the following formula (I):

$$(R_0)_n M(Y)_{x-n} \quad \text{(I)}$$

wherein $R_0$ represents a hydrogen atoms, a hydrocarbon group or a heterocyclic group; Y represents a reactive group; M represents a metallic atom having from 3 to 6 valences; x represents a valence of the metallic atom M; and n represents 0, 1, 2, 3 or 4, provided that the balance of x−n is not less than 2.

(1-3) The lithographic printing plate precursor as described in the item (1), which is a printing plate precursor for forming an image with an electrophotographic recording system.

(1-4) The lithographic printing plate precursor as described in the item (1), which is a printing plate precursor for forming an image with an ink jet recording system.

(1-5) The lithographic printing plate precursor as described in the embodiment (1-3), wherein the water-resistant support has a specific electric resistance of from $10^4$ to $10^{13}$ Ω·cm at least in the part just under the image-receiving layer.

(1-6) The lithographic printing plate precursor as described in the embodiment (1-4), wherein the water-resistant support has a specific electric resistance of not higher than $10^{10}$ Ω·cm at least in the part just under the image-receiving layer.

(2-1) The method for preparing a lithographic printing plate as described in the item (2), wherein image formation utilizing the electrophotographic recording system is carried out with a liquid developer.

(2-2) The method for preparing a lithographic printing plate as described in the item (2), wherein the water-resistant support has a specific electric resistance of from $10^4$ to $10^{13}$ Ω·cm at least in the part just under the image-receiving layer.

(3-1) The method for preparing a lithographic printing plate as described in the item (3), wherein image formation utilizing the ink jet recording system is carried out by ejecting dropwise oil-based ink.

(3-2) The method for preparing a lithographic printing plate as described in the embodiment (3-1), wherein the oil-based ink comprises a nonaqueous solvent having an electric resistance of $10^9$ Ω·cm or more and a dielectric constant of 3.5 or below and colored or colorless hydrophobic resin particles dispersed therein which are solid at ordinary temperature, and further colored particles when the resin particles are colorless.

(3-3) The method for preparing a lithographic printing plate as described in the embodiment (3-1), wherein the particles dispersed in the oil-based ink are positively or negatively charged particles and the oil-based ink is ejected by utilizing electrostatic attraction.

(3-4) The method for preparing a lithographic printing plate as described in the item (3), wherein the water-resistant support has a specific electric resistance of $10^{10}$ Ω·cm or below at least in the part just under the image-receiving layer.

Now, the lithographic printing plate precursor according to the present invention will be described in more detail below.

The image-receiving layer which is provided on a water-resistant support in the lithographic printing plate precursor according to the present invention contains, as the main components, anatase-type titanium oxide grains and a binder resin comprising a complex composed of an organo-metallic polymer and an organic polymer containing at least one member selected from the group consisting of an amido bond, a urethane bond, a ureido bond and a hydroxy group.

The image-receiving layer of the printing plate precursor according to the present invention has the contact angle with water of at least 25 degrees. The contact angle thereof is preferably from 30 to 120 degrees, more preferably from 40 to 100 degrees.

The contact angle of the surface of the image-receiving layer with water is determined in the following manner. Two μl of distilled water is put on the surface of the light-sensitive layer at room temperature (from 15 to 35° C.) and 30 seconds after, the contact angle of the surface of the image-receiving layer with water is measured by a surface contact meter (CA-D manufactured by Kyowa Kaimen Kagaku Co., Ltd.). The contact angle with water described herein is determined in the above manner.

By adjusting the contact angle to the above described range, the images formed adhere satisfactorily to the image-receiving layer. As a result, the resulting printing plate can inhibit the image area from disappearance when it undergoes printing.

Further, the image-receiving layer is characterized in that, when the image-receiving layer is irradiated with ultraviolet light, the above described hydrophobic surface condition of the non-image area is converted into a hydrophilic surface condition having the contact angle with water of not greater than 15 degrees, preferably not greater than 10 degrees, most preferably not greater than 5 degrees.

Moreover, the printing plate precursor according to the present invention is characterized in that, even the printing plate rendered the non-image area hydrophilic is allowed to stand for a long time, the hydrophilic condition is fully retained.

The image-receiving layer according to the present invention preferably has a surface smoothness of at least 30 (sec/10 ml), in terms of a Bekk smoothness.

The term "Bekk smoothness" as used herein means a Bekk smoothness degree measured by a Bekk smoothness tester. In the Bekk smoothness tester, a sample piece is pressed against a circular glass plate having a highly smooth finish and a hole at the center while applying thereto a definite pressure (1 kg/cm$^2$), and a definite volume (10 ml) of air is forced to pass between the sample piece and the glass surface under reduced pressure. Under this condition, a time (expressed in second) required for the air passage is measured.

In a case where images are formed on the lithographic printing plate precursor by means of an electrophotographic printer, an appropriate range of the Bekk smoothness depends on whether the toner used in the electrophotographic printer is dry toner or liquid toner.

More specifically, in the case of using dry toner in the electrophotographic printer, it is desirable that the Bekk smoothness of the image-receiving layer surface be preferably from 30 to 200 (sec/10 ml), more preferably from 50 to 150 (sec/10 ml). In the above described range, the adhesion of scattered toner to the non-image area (occurrence of backgrounds stain) is prevented and the toner adheres uniformly and firmly to the image area in the process of transferring and fixing the toner image to the printing plate precursor, whereby satisfactory reproduction of fine lines and fine letters and uniformity in the solid image area can be achieved.

In the case of using liquid toner in the electrophotographic printer, it is desirable for the image-receiving layer surface to have the Bekk smoothness of at least 30 (sec/10 ml), and the toner images transferred and fixed thereto can have better quality the higher the Bekk smoothness is. Specifically, the range thereof is preferably from 150 to 3,000 (sec/10 ml), more preferably from 500 to 2,500 (sec/10 ml).

In the above described range, highly accurate toner images can be transferred faithfully to the image-receiving layer, and fixed thereto so firmly as to ensure sufficient strength in the image area.

In a case where images are formed by means of an ink jet printer, the Bekk smoothness of the lithographic printing plate precursor surface is preferably from 50 to 2,500 (sec/10 ml), more preferably from 60 to 2,000 (sec/10 ml).

The titanium oxide grains used in the present invention comprises those having the crystal structure of anatase type, and are characterized by undergoing photoexcitation upon irradiation with ultraviolet light to render their surfaces hydrophilic.

The details of the surface conversion phenomenon from the hydrophobic condition to the hydrophilic condition upon irradiation with light are described, e.g., in Toshiya Watanabe, *Ceramics*, Vol. 31, No. 10, p. 837 (1966).

An average particle size of the anatase-type titanium oxide grain is preferably from 5 to 500 nm, more preferably from 5 to 100 nm. In such a range, the particle surface can advantageously obtain an appropriate hydrophilicity by irradiation with ultraviolet light.

The anatase-type titanium oxide grains are commercially available as powder or a titania sol dispersion produced, e.g., by Ishihara Sangyo Kaisha, Ltd., Titan Kogyo Kabushiki Kaisha, Sakai Chemical Industry Co., Ltd., Japan Aerosil Inc., or Nissan Chemical Industries, Ltd.

Further, the anatase-type titanium oxide grains used in the present invention may contain further other metallic elements or oxides thereof. The term "contain" used herein includes the meanings of "cover the grain surface" and/or "carry in the inner part", and "dope in the inner part".

Examples of the other metallic element which may be contained in the titanium oxide grains include Si, Mg, V, Mn, Fe, Sn, Ni, Mo, Ru, Rh, Re, Os, Cr, Sb, In, Ir, Ta, Nb, Cs, Pd, Pt and Au. Specific examples thereof are described, e.g., in JP-A-7-228738, JP-A-7-187677, JP-A-8-81223, JP-A-8-257399, JP-A-8-283022, JP-A-9-25123, JP-A-9-71437 and JP-A-9-70532.

The amount of the other metallic element or oxide thereof which may be contained in the anatase-type titanium oxide grains is preferably not more than 10% by weight, more preferably not more than 5% by weight, based on the total anatase-type titanium oxide grains.

The anatase-type titanium oxide grains are preferably used from 30 to 95% by weight, more preferably from 50 to 80% by weight in the image-receiving layer.

The binder resin employed in the image-receiving layer according to the present invention is characterized by comprising a complex composed of an organometallic polymer and an organic polymer containing at least one member selected from the group consisting of an amido bond, a urethane bond, a ureido bond and a hydroxy group. The organometallic polymer means a polymer mainly containing a bond of "oxygen atom-metal atom-oxygen atom". The term "amido bond" used with respect to the organic polymer herein includes a carboxylic amido bond and a sulfonamido bond, and the carboxylic amido bond includes not only an

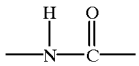

bond but also an

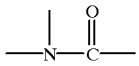

bond. The term "complex composed of an organometallic polymer and an organic polymer" includes both a sol substance and a gel substance.

The organometallic polymer used in the present invention is preferably a polymer obtained by a hydrolysis reaction and a polymerization condensation reaction of a organometallic compound represented by formula (I) shown below. The organometallic compounds may be used individually or as a mixture of two or more thereof.

$$(R^0)_nM(Y)_{x-n} \quad (I)$$

wherein $R^0$ represents a hydrogen atom, a hydrocarbon group or a heterocyclic group; Y represents a reactive group; M represents a metallic atom having from 3 to 6 valences; x represents a valence of the metallic atom M; and n represents 0, 1, 2, 3 or 4, provided that the balance of x−n is not less than 2.

In formula (I), $R^0$ preferably represents a hydrogen atom; an unsubstituted or substituted straight chain or branched chain alkyl group having from 1 to 12 carbon atoms [e.g., methyl, ethyl, propyl, butyl, pentyl, hexyl, heptyl, octyl, nonyl, decyl and dodecyl groups, which each may have one or more substituents, such as a halogen atom (e.g., chlorine, fluorine or bromine atom), a hydroxy group, a thiol group, a carboxy group, a sulfo group, a cyano group, an epoxy group, an —OR' group (wherein R' represents a hydrocarbon group, e.g., methyl, ethyl, propyl, butyl, heptyl, hexyl, octyl, decyl, propenyl, butenyl, hexenyl, octenyl, 2-hydroxyethyl, 3-chloropropyl, 2-cyanoethyl, N,N-dimethylaminoethyl, 2-bromoethyl, 2-(2-methoxyethyl)-oxyethyl, 2-methoxycarbonylethyl, 3-carboxypropyl or benzyl), an —OCOR" group (wherein R" has the same meaning as R'), a —COOR" group, a —COR" group, an $—N(R'')_2$ group (wherein R'", which may be the same or different, each represents a hydrogen atom or a group same as defined for R', an —NHCONHR" group, an —NHCOOR" group, a $—Si(R'')_3$ group, a —CONHR'" group and a —NHCOR" group]; an unsubstituted or substituted straight chain or branched chain alkenyl group having from 2 to 12 carbon atoms [e.g., vinyl, propenyl, butenyl, pentenyl, hexenyl, octenyl, decenyl and dodecenyl groups, which each may have one or more substituents selected from those described for the foregoing alkyl group]; an unsubstituted or substituted aralkyl group having from 7 to 14 carbon atoms [e.g., benzyl, phenetyl, 3-phenylpropyl, naphthylmethyl and 2-naphthylethyl groups, which each may have one ore more substituents selected from those described for the foregoing alkyl group]; an unsubstituted or substituted alicyclic group having from 5 to 10 carbon atoms [e.g., cyclopentyl, cyclohexyl, 2-cyclohexylethyl, 2-cyclopentylethyl, norbornyl and adamantyl groups, which each may have one or more substituents selected from those described for the foregoing alkyl group]; an unsubstituted or substituted aryl group having 6 to 12 carbon atoms [e.g., phenyl and naphthyl groups, which each may have one or more substituents selected from those described for the foregoing alkyl group]; or an unsubstituted or substituted heterocyclic group which may have a condensed ring, containing at least one atom selected from nitrogen, oxygen and sulfur atoms [examples of the hetero ring include pyran, furan, thiophene, morpholine, pyrrole, thiazole, oxazole, pyridine, piperidine, pyrrolidone, benzothiazole, benzoxazole, quinoline and tetrahydrofuran rings, which each may have one or more substituents selected from those described for the foregoing alkyl group].

Preferred examples of the reactive group represented by Y in formula (I) include a hydroxy group, a halogen atom (e.g., fluorine, chlorine, bromine or iodine atom), an $—OR^1$ group, an $—OCOR^2$ group, a $—CH(COR^3)(COR^4)$ group, a $—CH(COR^3)(COOR^4)$ group or an $—N(R^5)(R^6)$ group.

In the group of $—OR^1$, $R^1$ represents an unsubstituted or substituted aliphatic group having from 1 to 10 carbon atoms (e.g., methyl, ethyl, propyl, butyl, pentyl, hexyl, heptyl, octyl, nonyl, decyl, propenyl, butenyl, heptenyl, hexenyl, octenyl, decenyl, 2-hydroxyethyl, 2-hydroxypropyl, 2-methoxyethyl, 2-(methoxyethoxy)ethyl, 2-(N,N-diethylamino)ethyl, 2-methoxypropyl, 2-cyanoethyl, 3-methoxypropyl, 2-chloroethyl, cyclohexyl, cyclopentyl, cyclooctyl, chlorocyclohexyl, methoxycyclohexyl, benzyl, phenetyl, dimethoxybenzyl, methylbenzyl, or bromobenzyl).

In the group of $—OCOR^2$, $R^2$ represents an aliphatic group same as defined for $R^1$, or an unsubstituted or substituted aromatic group having from 6 to 12 carbon atoms (e.g., aryl groups same as described for the forgoing $R^0$).

In the group of $—CH(COR^3)(COR^4)$ or the group of $—CH(COR^3)(COOR^4)$, $R^3$ represents an alkyl group having from 1 to 4 carbon atoms (e.g., methyl, ethyl, propyl or butyl) or an aryl group (e.g., phenyl, tolyl or xylyl), and $R^4$ represents an alkyl group having from 1 to 6 carbon atoms (e.g., methyl, ethyl, propyl, butyl, pentyl or hexyl), an aralkyl group having from 7 to 12 carbon atoms (e.g., benzyl, phenethyl, phenylpropyl, methylbenzyl, methoxybenzyl, carboxybenzyl or chlorobenzyl) or an aryl group (e.g., phenyl, tolyl, xylyl, mesityl, methoxyphenyl, chlorophenyl, carboxyphenyl or diethoxyphenyl).

In the group of $—N(R^5)(R^6)$, $R^5$ and $R^6$, which may be the same or different, each represents a hydrogen atom or an unsubstituted or substituted aliphatic group having from 1 to 10 carbon atoms (e.g., aliphatic groups same as described for $R^1$ in the foregoing group of $—OR^1$). More preferably, the total number of carbon atoms contained in $R^5$ and $R^6$ are 12 or less.

Preferred examples of the metallic atom represented by M include metallic atoms of transition metals, rare earth metals and metals of III to V groups of periodic table. More preferred metals include Al, Si, Sn, Ge, Ti and Zr, and still more preferred metals include Al, Si, Sn, Ti and Zr. Particularly, Si is preferred.

Now, the organic polymer used in the present invention will be described in more detail below.

The organic polymer includes a polymer containing, as a repeating unit component, a component having at least one bond selected from $—N(R^{10})CO—$, $—N(R^{10})SO_2—$, —NHCONH— and —NHCOO— in the main chain or side chain thereof, and a polymer containing, as a repeating unit component, a component having a hydroxy group. In the above-described amido bonds, $R^{10}$ represents a hydrogen atom or an organic residue, and the organic residue includes the hydrocarbon group and heterocyclic group represented by $R^0$ in formula (I).

The organic polymer containing the specific bond in its main chain according to the present invention includes an amide resin having the —N($R^{10}$)CO— or —N($R^{10}$)$SO_2$— bond, a ureido resin having the —NHCONH— bond, and a urethane resin having the —NHCOO— bond.

As diamines and dicarboxylic acids used for preparation of the amide resins, diisocyanates used for preparation of the ureido resins and diols used for preparation of the urethane resins, compounds described, for example, in *Polymer Data Handbook, Fundamental Volume*, Chapter I, edited by Polymer Science Society, Baifukan (1986) and *Handbook of Cross-linking Agents*, edited by Shinzo Yamashita and Tosuke Kaneko, Taiseisha (1981).

Other examples of the polymer containing the amido bond include a polymer containing a repeating unit represented by formula (II) shown below, N-acylated polyalkyleneimine, and polyvinylpyrrolidone and derivatives thereof.

(II)

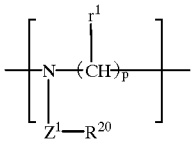

wherein, $Z^1$ represents —CO— or —CS—; $R^{20}$ represents a hydrogen atom, a hydrocarbon group or a heterocyclic group (the hydrocarbon group and heterocyclic group having the same meanings as those defined for $R^0$ in formula (I), respectively); $r^1$ represents hydrogen atom or an alkyl group having from 1 to 6 carbon atoms (e.g., methyl, ethyl, propyl, butyl, pentyl or hexyl), $r^1$s may be the same or different; and p represents an integer of 2 or 3.

Among the polymers containing a repeating unit represented by formula (II), a polymer wherein $Z^1$ represents —CO— and p is 2 can be obtained by ring-opening polymerization of oxazoline which may be substituted in the presence of a catalyst. The catalyst which can be used includes a sulfuric ester or sulfonic ester (e.g., dimethyl sulfate or an alkyl p-toluenesulfonate), an alkyl halide (e.g., an alkyl iodide such as methyl iodide), a fluorinated metallic compound of Friedel-Crafts catalyst, and an acid (e.g., sulfuric acid, hydrogen iodide or p-toluenesulfonic acid) or an oxazolinium salt thereof formed from the acid and oxazoline.

The polymer may be a homopolymer or a copolymer. The polymer also includes a graft polymer containing the units derived from oxazoline in its graft portion.

Specific examples of the oxazoline include 2-oxazoline, 2-methyl-2-oxazoline, 2-ethyl-2-oxazoline, 2-propyl-2-oxazoline, 2-isopropyl-2-oxazoline, 2-butyl-2-oxazoline, 2-dichloromethyl-2-oxazoline, 2-trichloromethyl-2-oxazoline, 2-pentafluoroethyl-2-oxazoline, 2-phenyl-2-oxazoline, 2-methoxycarbonylethyl-2-oxazoline, 2-(4-methylphenyl)-2-oxazoline, and 2-(4-chlorophenyl)-2-oxazoline. Preferred examples of the oxazoline include 2-oxazoline, 2-methyl-2-oxazoline, 2-ethyl-2-oxazoline. The oxazolines may be employed individually or as a mixture of two or more thereof.

Other polymers containing a repeating unit represented by formula (II) are also obtained in the same manner as described above except for using thiazoline, 4,5-dihydro-1,3-oxazine or 4,5-dihydro-1,3-thiazine in place of oxazoline.

The N-acylated polyalkyleneimine includes a carboxylic amide compound containing an —N(CO—$R^{20}$)— bond obtained by a polymer reaction of polyalkyleneimine with a carboxylic halide and a sulfonamide compound containing an —N($SO_2$—$R^{20}$)— bond obtained by a polymer reaction of polyalkyleneimine with a sulfonyl halide.

The organic polymer containing the specific bond in the side chain thereof according to the present invention includes a polymer containing as the main component, a component having at least one bond selected from the specific bonds.

Specific examples of the component having the specific bond include repeating units derived from acrylamide, methacrylamide, crotonamide and vinyl acetamide, and the repeating units shown below, but the present invention should not be construed as being limited thereto.

(1)

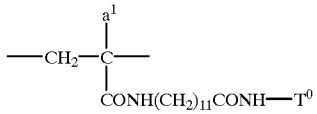

$a^1$: —H, —$CH_3$
$l_1$: an integer from 1 to 4
$T^0$: —H, —$CH_3$, —$(CH_2)_2OCH_3$, —$(CH_2)_2N(CH_3)_2$ (2)

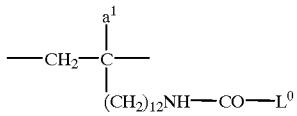

$l_2$: 0 or 1
$L^0$: —$C_{n1}H_{2n1+1}$ ($n_1$: an integer from 1 to 4), —$(CH_2)_2OCH_3$, —$(CH_2)_3N(CH_3)_2$, —$CH_2C_6H_5$, —$(CH_2)_{n1}OH$ (3)

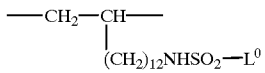

(4)

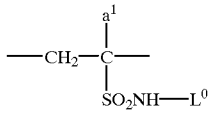

(5)

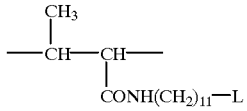

(6)

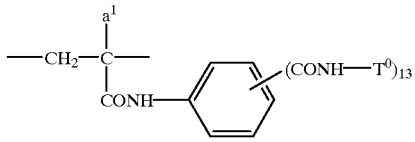

$l_3$: 0, 1 or 2

(7)

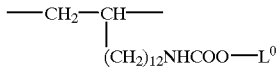

(8)

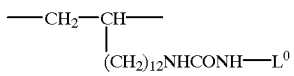

(9)

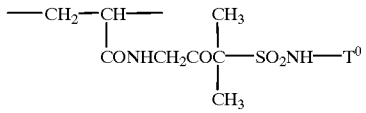

-continued (10)

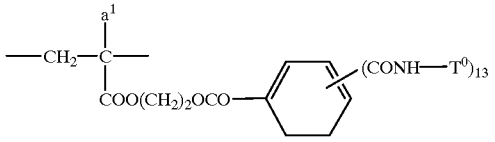

(11)

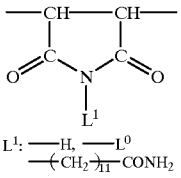

(12)

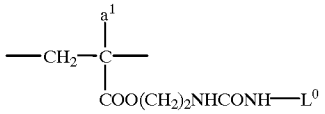

(13)

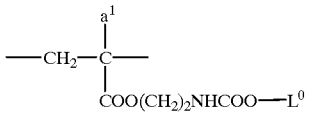

(14)

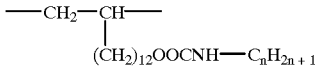

(15)

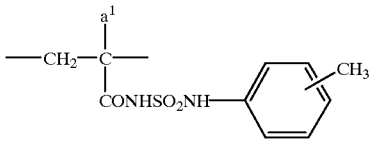

(16)

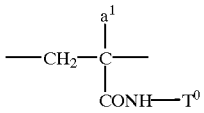

The organic polymer containing a hydroxy group according to the present invention may be any of natural water-soluble polymers, semisynthetic water-soluble polymers and synthetic water-soluble polymers, and include those described, for example, in *Water-Soluble Polymers.Agueous Dispersion Type Resins: Collective Technical Data*, Keiei Kaihatsu Center Publishing Division (1981), Sinji Nagatomo, *New Applications and Market of Water-Soluble Polymers*, CMC (1988), and *Development of Functional Cellulose*, CMC (1985).

Specific examples of the natural and semisynthetic water-soluble polymers include cellulose, cellulose derivatives (e.g., cellulose esters such as cellulose nitrate, cellulose sulfate, cellulose acetate, cellulose propionate, cellulose succinate, cellulose butyrate, cellulose acetate succinate, cellulose acetate butyrate or cellulose acetate phthalate; and cellulose ethers such as methylcellulose, ethylcellulose, cyanoethylcellulose, carboxymethylcellulose, hydroxyethylcellulose, hydroxypropylcellulose, ethyl hydroxyethylcellulose, hydroxypropyl methylcellulose or carboxymethyl hydroxyethylcellulose), starch, starch derivatives (e.g., oxidized starch, esterified starch including those esterified with an acid such as nitric acid, sulfuric acid, phosphoric acid, acetic acid, propionic acid, butyric acid or succinic acid; and etherified starch such as methylated starch, ethylated starch, cyanoethylated starch, hydroxyalkylated starch or carboxymethylated starch), alginic acid, pectin, carrageenan, tamarind gum, natural rubber (e.g., gum arabic, guar gum, locust bean gum, tragacanth gum or xanthane gum), pullulan, dextran, casein, gelatin, chitin and chitosan.

Specific examples of the synthetic water-soluble polymer include polyvinyl alcohol, polyalkylene glycols (e.g., polyethylene glycol, polypropylene glycol or ethylene glycol/propylene glycol copolymers), allyl alcohol copolymers, homopolymers or copolymers of acrylate or methacrylate containing at least one hydroxy group (examples of ester portion including a 2-hydroxyethyl, 3-hydroxypropyl, 2,3-dihydroxypropyl, 3-hydroxy-2-hydroxy-methyl-2-methylpropyl, 3-hydroxy-2,2-di(hydroxymethyl)-propyl, polyoxyethylene and polyoxypropylene group), homopolymers or copolymers of N-substituted acrylamide or methacrylamide containing at least one hydroxy group (examples of N-substituent including a monomethylol, 2-hydroxyethyl, 3-hydroxypropyl, 1,1-bis(hydroxymethyl)ethyl and 2,3,4,5,6-pentahydroxypentyl group). However, the synthetic water-soluble polymer is not particularly limited as long as it contains at least one hydroxy group in the side chain substituent of the repeating unit thereof.

The weight average molecular weight of the organic polymer constituting the complex used in the image-receiving layer according to the present invention is preferably from $1\times10^3$ to $1\times10^6$, more preferably from $5\times10^3$ to $4\times10^5$.

In the complex composed of an organometallic polymer and an organic polymer according to the present invention, a ratio of the organometallic polymer to the organic polymer can be selected from a wide range, and a weight ratio of organometallic polymer/organic polymer is preferably from 10/90 to 90/10, more preferably from 20/80 to 80/20.

In such a range, the desired film-strength and water-resistance of the image-receiving layer during printing are advantageously effected.

The binder resin comprising the complex of organic polymer and inorganic polymer according to the present invention forms a uniform organic/inorganic hybrid by means of the function of hydrogen bonds generated between hydroxy groups of the organometallic polymer produced by the hydrolysis polymerization condensation of the organometallic compounds as described above and the above described specific bonds or hydroxy groups in the organic polymer and is microscopically homogeneous without the occurrence of phase separation. Also, it is believed that the affinity between the organometallic polymer and the organic polymer is more improved because of the function of the hydrocarbon group included in the organometallic polymer. Further, the complex of the organometallic polymer and the organic polymer is excellent in a film-forming property.

The complex of resins can be prepared by subjecting the organometallic compound to the hydrolysis polymerization condensation and then mixing with the organic polymer, or by conducting the hydrolysis polymerization condensation of the organometallic compound in the presence of the organic polymer.

Preferably, the complex of organic polymer and inorganic polymer according to the present invention is prepared by conducting the hydrolysis polymerization condensation of the organometallic compound in the presence of the organic polymer according to a sol-gel method. In the complex of organic polymer and inorganic polymer thus prepared, the organic polymer is uniformly dispersed in a matrix (i.e., three-dimensional micro-network structure of inorganic matal oxide) of gel prepared by the hydrolysis polymerization condensation of the organometallic compound.

The sol-gel method in the present invention may be performed according to any of conventionally well-known sol-gel methods. More specifically, it is conducted with reference to methods described in detail, for example, in *Thin Film Coating Technology by Sol-Gel Method*, Gijutsu-joho Kyokai (1995), Sumio Sakibana, *Science of Sol-Gel Method*, Agne Shofusha (1988), and Seki Hirashima, *Latest Technology of Functional Thin Film Formation by Sol-Gel Method*, Sogo Gijutu Center (1992).

In a coating solution for the image-receiving layer, an aqueous solvent is preferably used. A water-soluble solvent is also employed together therewith in order to prevent precipitation during the preparation of coating solution, thereby forming a homogenous solution. Examples of such a water-soluble solvent include an alcohol (such as methanol, ethanol, propyl alcohol, ethylene glycol, diethylene glycol, propylene glycol, dipropylene glycol, ethylene glycol monomethyl ether, propylene glycol monomethyl ether and ethylene glycol monoethyl ether), an ether (such as tetrahydrofuran, ethylene glycol dimethyl ether, propylene glycol dimethyl ether and tetrahydrofuran), a ketone (such as acetone, methyl ethyl ketone and acetylacetone), an ester (such as methyl acetate and ethylene glycol monomethylmonoacetate) and an amide (such as formamide, N-methylformamide, pyrrolidone and N-methylpyrrolidone). These solvents may be used individually or as a mixture of two or more thereof.

In the coating solution, it is preferred to further use an acidic or basic catalyst for the purpose of accelerating the hydrolysis and polycondensation reaction of the organometallic compound represented by formula (I).

The catalyst used for the above purpose is an acidic or basic compound itself or an acidic or basic compound dissolved in a solvent, such as water or an alcohol (such a compound is hereinafter referred to as an acidic catalyst or a basic catalyst respectively). The concentration of catalyst is not particularly limited, but the high catalyst concentration tends to increase the hydrolysis speed and the polycondensation speed. However, since the basic catalyst used in a high concentration may cause precipitation in the sol solution, it is desirable that the basic catalyst concentration be not higher than one normal (1N), as a concentration in the aqueous solution.

The acidic catalyst or the basic catalyst used has no particular restriction as to the species. In a case where the use of a catalyst in a high concentration is required, however, a catalyst constituted of elements which leave no residue in crystal grains obtained after sintering is preferred. Suitable examples of the acidic catalyst include a hydrogen halide (e.g., hydrogen chloride), nitric acid, sulfuric acid, sulfurous acid, hydrogen sulfide, perchloric acid, hydrogen peroxide, carbonic acid, a carboxylic acid (e.g., formic acid or acetic acid), a substituted carboxylic acid (e.g., an acid represented by formula of RCOOH wherein R is an element or a substituent other than —H and $CH_3$—), and a sulfonic acid (e.g., benzenesulfonic acid). Suitable examples of the basic catalyst include an ammoniacal base (e.g., aqueous ammonia) and an amine (e.g., ethylamine or aniline).

In addition to the above described components, the image-receiving layer according to the present invention may contain other ingredients.

Examples of other ingredients include inorganic pigment particles other than the anatase-type titanium oxide grains. Examples of such an inorganic pigment include silica, alumina, kaolin, clay, zinc oxide, calcium carbonate, barium carbonate, calcium sulfate, barium sulfate, magnesium carbonate, and titanium oxide having a crystal structure other than the anatase type. The inorganic pigment particles are used in a proportion of preferably not higher than 40 parts by weight, more preferably not higher than 20 parts by weight, based on 100 parts by weight of the anatase-type titanium oxide grains used.

The binder resin/total pigment particle (including the anatase-type titanium oxide grains, the inorganic pigment particles etc.,) ratio in the image-receiving layer is preferably from 8/100 to 50/100 by weight, more preferably from 10/100 to 30/100 by weight. In such a range, the effects of the present invention are efficiently achieved, and the layer strength can be retained and the good hydrophilicity in the non-image area obtained by desensitizing treatment upon irradiation with ultraviolet light can be maintained during printing.

Also, the images firmly adhere to the image-receiving layer and the printing plate exhibits good press life. Specifically, disappearance of image does not occur after printing a large number of sheets.

To the image receiving layer, a cross-linking agent may be added for increasing the layer strength thereof.

The cross-linking agent usable herein include compounds ordinarily used as cross-linking agent. Specifically, such compounds as described, e.g., in *Handbook of Cross-linking Agents*, edited by Shinzo Yamashita and Tosuke Kaneko, Taiseisha (1981) and *Polymer Data Handbook*, Fundamental Volume, edited by Polymer Science Society, Baifukan (1986).

Examples of cross-linking agent which can be used include ammonium chloride, metal ions, organic peroxides, polyisocyanate compounds (e.g., toluylene diisocyanate, diphenylmethane diisocyanate, triphenylmethane triisocyanate, polymethylene phenylisocyanate, hexamethylene diisocyanate, isophorone diisocyanate, or high molecular polyisocyanate), polyol compounds (e.g., 1,4-butanediol, polyoxypropylene glycol, polyoxyethylene glycol, or 1,1,1-trimethylolpropane), polyamine compounds (e.g., ethylenediamine, γ-hydroxypropylated ethylenediamine, phenylenediamine, hexamethylenediamine, N-aminoethylpiperazine, or modified aliphatic polyamines), polyepoxy group-containing compounds and epoxy resins (e.g., compounds described in Hiroshi Kakiuchi, *New Epoxy Resins*, Shokodo (1985), and Kuniyuki Hashimoto, *Epoxy Resins*, Nikkan Kogyo Shinbunsha (1969)), melamine resins (e.g., compounds described in Ichiro Miwa & Hideo Matsunaga, *Urea.Melamine Resins*, Nikkan Kogyo Shinbunsha (1969)), and poly(meth)acrylate compounds (e.g., compounds described in Makoto Ogawara, Takeo Saegusa & Toshinobu Higashimura, *Oligomers*, Kodansha (1976), and Eizo Omori, *Functional Acrylic Resins*, Techno System (1985)).

The thus prepared coating solution is coated on a water-resistant support using any of conventionally well-known coating methods, and dried to form the image-receiving layer.

The thickness of the image-receiving layer thus formed is preferably from 0.2 to 10 μm, more preferably from 0.5 to 8 μm. In such a thickness range, the layer formed can have a uniform thickness and sufficient film-strength.

Examples of the water-resistant support usable in the present invention include an aluminum plate, a zinc plate, a bimetal plate such as a copper-aluminum plate, a copper-stainless steel plate or a chromium-copper plate, and a trimetal plate such as a chromium-copper-aluminum plate, chromium-lead-iron plate or a chromium-copper-stainless steel plate, which each has a thickness of preferably from 0.1 to 3 mm, more preferably from 0.1 to 1 mm. Also, paper subjected to water-resistant treatment, paper laminated with a plastic film or a metal foil, and a plastic film each preferably having a thickness of from 80 to 200 $\mu$m are employed.

The water-resistant support has preferably a highly smooth surface. Specifically, it is desirable for the support used in the present invention that the Bekk smoothness on the surface side which is contact with the image-receiving layer be adjusted to preferably at least 300 (sec/10 ml), more preferably from 900 to 3,000 (sec/10 ml), yet more preferably from 1,000 to 3,000 (sec/10 ml). By controlling the Bekk smoothness of the surface side of the support which is contact with the image-receiving layer to at least 300 sec/10 ml, the image reproducibility and the press life can be more improved. As such improving effects can be obtained even when the image-receiving layer having the same surface smoothness is used, the increase in the smoothness of the support surface is considered to increase the adhesion between the image area and the image-receiving layer.

The Bekk smoothness of the surface of the support can be measured in the same manner as described with respect to the image-receiving layer.

The expression "highly smooth surface of the water-resistant support" as used herein means a surface coated directly with the image-receiving layer. In other words, when the support has an under and/or overcoat layer, e.g., a conductive layer described below, the highly smooth surface denotes the surface of the under and/or overcoat layer.

Thus, the surface condition of the image-receiving layer can be controlled and fully kept without receiving the influence of surface roughness of the support used. As a result, it becomes possible to further improve the image quality.

The adjustment of the surface smoothness to the above described range can be made using various well-known methods. For instance, the Bekk smoothness of support surface can be adjusted by coating a substrate with a resin using a melt adhesion method, or by using a strengthened calender method utilizing highly smooth heated rollers.

In the case of utilizing an electrophotographic recording system to form images in the present invention, toner images are formed on the image-receiving layer provided on the water-resistant support with an electrophotographic process.

In general, the transfer of toner images to a material to be transferred in the electrophotographic process is carried out electrostatically. The printing plate precursor according to the present invention can be preferably employed as a lithographic printing plate precursor for the image formation by the electrostatic transfer, and the thus obtained lithographic printing plate can provide a large number of printed matter having clear images.

In the above case, it is preferred that the water-resistant support is electrically conductive. When the transfer of the toner images to the printing plate precursor is conducted electrostatically using a PPC duplicating machine, the specific electric resistance of the water-resistant support at least in the part just under the image-receiving layer is preferably from $10^4$ to $10^{13}$ Ω·cm, more preferably from $10^6$ to $10^{12}$ Ω·cm.

By adjusting the specific electric resistance to the above described range, blurs and distortion in the transferred image area and stains due to adhesion of toner to the non-image area can be prevented to a practically negligible extent, so that the images of good quality can be obtained. Further, the specific electric resistance of the water-resistant support as a whole is preferably from $10^4$ to $10^{13}$ Ω·cm and more preferably from $10^6$ to $10^{12}$ Ω·cm.

The lithographic printing plate precursor according to the present invention can also be preferably used as a printing plate precursor for forming images on the image-receiving layer provided on the water-resistant support with an ink jet recording method wherein oil-based ink is ejected utilizing electrostatic attraction. The lithographic printing plate prepared using the method can provide a great number of printed matter having clear images.

It is desirable for the water-resistant support used in the ink jet recording system to have electric conductivity. At least in the part just under the image-receiving layer, the support has the specific electric resistance of preferably not more than $10^{10}$ Ω·cm, more preferably $10^8$ Ω·cm or below.

For the water-resistant support as a whole, the specific electric resistance is preferably $10^{10}$ Ω·cm or below, and more preferably $10^8$ Ω·cm or below. The value may be infinitely close to zero.

The electric conductivity as described above can be conferred on the support in the part just under the image-receiving layer, e.g., by covering a substrate such as paper or film, with a layer comprising an electrically conductive filler such as carbon black, and a binder, by sticking a metal foil on a substrate, or by vapor-evaporating a metallic film onto a substrate.

On the other hand, examples of the support that is electrically conductive as the whole include electrically conductive paper impregnated with sodium chloride, a plastic film in which an electrically conductive filler such as carbon black is mixed, and a metal plate such as an aluminum plate.

In the above described range of electric conductivity, the charged ink droplets just after attaching to the image-receiving layer can quickly lose their electric charge through earth. Thus, clear images free from disorder can be formed.

The specific electric resistance (also referred to as volume specific electric resistance or specific resistivity, sometimes) is measured by a three-terminal method with a guard electrode according to the method described in JIS K-6911.

The electric conductivity adjustment of the support can be effected by adopting a method of imparting the electric conductivity on the support all over or a method of providing an electrically conductive layer on one side or both sides of a substrate. The terms "electric conductivity" and "electrically conductive" are hereinafter abbreviated as "conductivity" and "conductive" respectively.

First, the support that is conductive as the whole is described below.

Such a support can be prepared by using as a substrate a conductive base paper, such as paper impregnated with sodium chloride, and providing a conductive water-resistant layer on both sides of the substrate.

Examples of paper which can be used for preparing the conductive base paper include wood pulp paper, synthetic pulp paper, and paper made from a mixture of wood pulp and synthetic pulp. It is preferred for such paper to have a thickness of 80 to 200 $\mu$m.

In the case of providing a conductive layer on the base paper, the conductive layer comprises a conductive agent and a binder.

The conductive agents which can be used include both inorganic and organic ones. The conductive agents may be used individually or as a mixture of two or more thereof. Examples of the inorganic conductive agent include salts of monovalent metals such as Na, K and Li, salts or oxides of polyvalent metals such as Mg, Ca, Ba, Zn, Ti, Co, Ni, Zr, Al and Si, and ammonium salts. The organic conductive agents may be any of low molecular compounds and high molecular compounds which have conventionally been used as conductivity imparting agents, antistatic agents or surfactants. Examples of such a compound include conductive fillers (for example, granular carbon black or graphite, metal powder such as silver, copper, nickel, brass aluminum, steel or stainless steel powder, tin oxide powder, flaky aluminum or nickel, or fibrous carbon), metal soaps (such as metal salts of organic carboxylic acids, sulfonic acid or phosphonic acid), quaternary salt compounds (such as quaternary ammonium salts or quaternary phosphonium salts), anionic surfactants, nonionic surfactants, cationic surfactants, alcoholic compounds (such as acetylene-1,2-diol, xylylene diol or bisphenol A). These compounds may be used individually or as a mixture of two or more thereof.

The amount of the conductive agent added to the conductive layer is preferably from 3 to 50% by weight, more preferably from 5 to 30% by weight, based on the binder resin used in the layer.

The binder resin used together with the conductive agent can be appropriately selected from various kinds of resins. Examples of a resin suitable for the binder include hydrophobic resins, for example, acrylic resins, vinyl chloride resins, styrene resins, styrene-butadiene resins, styrene-acrylic resins, urethane resins, vinylidene chloride resins and vinyl acetate resins, and hydrophilic resins, for example, polyvinyl alcohol resins, cellulose derivatives, starch and derivatives thereof, polyacrylamide resins, copolymers of vinyl ether and maleic anhydride, and copolymers of styrene and maleic anhydride.

The coverage rate of such a conductive layer is preferably from 1 to 30 g/m$^2$, more preferably from 3 to 20 g m$^2$.

Another method for forming the conductive layer is to laminate a conductive thin film. Examples of such a conductive thin film usable include a metallic foil and a conductive plastic film. More specifically, an aluminum foil can be used for the metallic foil, and a polyethylene resin film in which carbon black is incorporated can be used for the conductive plastic film. Both hard and soft aluminum foils can be used as the laminating material. The thickness of the conductive thin films is preferably from 5 to 20 $\mu$m.

For the lamination of a polyethylene resin in which carbon black is incorporated, it is preferred to adopt an extrusion lamination method. This method includes the steps of melting the polyethylene resin by heating, forming the molten resin into a film, pressing the film immediately against the base paper and the cooling them, and can be carried out with various well-known apparatuses. The thickness of the laminated layer is preferably from 10 to 30 $\mu$m.

As the support having conductivity as a whole, a conductive plastic film and a metal plate can be used as they are as far as they have a satisfactory water-resistant property.

The conductive plastic film includes, e.g., a polypropylene or polyester film in which a conductive filler such as carbon fiber or carbon black is mixed, and the metal plate includes, e.g., an aluminum plate. The thickness of a substrate is preferably from 80 to 200 $\mu$m. When the substrate has a thickness of less than 80 $\mu$m, it may not ensure sufficient strength in the printing plate. On the other hand, when the thickness of the substrate is more than 200 $\mu$m, the handling property such as transportability in a recording apparatus may tend to decrease.

The support having a conductive layer provided on one side or both sides of the water-resistant substrate is described below.

As the water-resistant substrate, paper subjected to water-resistant treatment, paper laminated with a plastic film or a metal foil and a plastic film each preferably having a thickness of from 80 to 200 $\mu$m can be used.

As a method for forming a conductive layer on the substrate, the same methods as described in the case where the whole of the support is conductive, can be used. More specifically, the composition containing a conductive filler and a binder is coated on one side of the substrate to form a layer having a thickness of from 5 to 20 $\mu$m. Also, the conductive layer is formed by laminating a metal foil or a conductive plastic film on the substrate.

Another method which may be employed comprises depositing a metal film such as an aluminum, tin, palladium or gold film onto a plastic film.

Thus, the water-resistant support having the electrically conductive property can be obtained.

For preventing the printing plate precursor from curling, the support may have a backcoat layer (backing layer) on the side opposite to the image-receiving layer. It is preferred that the backcoat layer has the Bekk smoothness of 150 to 700 (sec/10 ml).

By providing such a backcoat layer on the support, the printing plate obtained can be mounted exactly in an offset printing machine without suffering shear or slippage.

The thickness of the water-resistant support provided with an under layer or a backcoat layer is from 90 to 130 $\mu$m, more preferably from 100 to 120 $\mu$m.

Thus, clear images free from background stains can be formed in a plate-making utilizing a PPC duplicating machine of electrostatic transfer type. The toner images are sufficiently fixed, so that disappearance of toner images does not occur when printing pressure and adhesion of ink are imposed thereon during the offset printing operation.

Image formation on the lithographic printing plate precursor can be performed by any appropriate method, for example, an electrophotographic recording system, an ink jet recording system or a heat-sensitive transfer recording system. First, image formation using the electrophotographic recording system is described below.

The electrophotographic recording method employed herein may be any of various well-known recording systems. For instance, the recording systems described, e.g., in *The Fundamentals and Applications of Electrophotographic Techniques*, edited by Electrophotographic Society, Corona Co. (1988), Kenichi Eda, *Journal of Electrophotographic Society*, 27, 113 (1988), and Akio Kawamoto, ibid., 33, 149 (1994) and 32, 196 (1993); and commercially available PPC duplicating machines can be employed.

A combination of an exposure system in which the exposure is performed by scanning the laser beams based on digital information with a development system using a liquid developer can be adopted as an effective method for image information, because it enables the formation of highly accurate images. One example utilizing such a combination is illustrated below.

A photosensitive material is positioned on a flat bed by a register pin system, and fixed to the flat bed by undergoing air suction from the back side. Then, the photosensitive material is charged by means of a charging device described, e.g., in the above-described reference, *The Fundamentals and Applications of Electrophotographic Techniques*, p. 212 et seq. Specifically, a corotron or scotron system is ordinarily used for charging. At the time of charging, it is also preferred to control the charging condition so that the surface potential of the photosensitive material is always kept within the intended range through a feedback system based on the information from a means of detecting the potential of the charged photosensitive material. Thereafter, the scanning exposure using a laser-beam source is performed according to, e.g., the method as described in the reference described above, p. 254 et seq.

Then, toner image formation is carried out with a liquid developer. The photosensitive material charged and exposed on the flat bed is detached from the flat bed, and subjected to wet development as described in the reference described above, p. 275 et seq. The exposure is carried out in a mode corresponding to the toner image development mode. In the case of reversal development, for instance, a negative image, or an image area, is exposed to laser beams, a toner having the same charge polarity as the charged photosensitive material is employed, and the toner is adhered electrically to the exposed area by applying a bias voltage for development. The principle of this process is explained in detail in the reference described above, p. 157 et seq.

For removal of excess developer after development, the photosensitive material is squeegeed with a rubber roller, a gap roller or a reverse roller, or subjected to corona squeegee or air squeegee as described at page 283 of the above-described reference. Before such a squeegee treatment, the photosensitive material is preferably rinsed with only a carrier liquid of the liquid developer.

Then, the toner image formed on the photosensitive material is transferred onto the lithographic printing plate precursor according to the present invention directly or via a transfer intermediate, and fixed to the printing plate precursor.

Image formation using an ink jet recording system is described below.

The ink jet recording may be performed using any of well-known ink jet recording systems. However, the use of oil-based ink is desirable because it ensures quick drying and satisfactory fixation of the ink image and hardly clogs a nozzle and a filter, and the adoption of an electrostatic ejection type ink jet recording system is desirable because it hardly causes image blurs.

Now, the electrostatic ejection type ink jet recording system utilizing oil-based ink is described in detail below.

The oil-based ink used in the present invention is a dispersion of hydrophobic resin particles, which are solid at least at ordinary temperature (15 to 35° C.), in a nonaqueous solvent, preferably having an electric resistance of $10^9$ Ω·cm or more and a dielectric constant of 3.5 or below. By using such a nonaqueous solvent as a dispersing medium, the electric resistance of the oil-based ink can be controlled appropriately. As a result, the ejection of ink by the action of an electric field can be properly carried out, whereby the image quality is improved. Further, since the use of resin particles as described above can provide an enhanced affinity for the image-receiving layer, images of good quality can be formed and press life can be improved.

Preferred examples of the nonaqueous solvent having an electric resistance of $10^9$ Ω·cm or more and a dielectric constant of 3.5 or below include straight chain or branched aliphatic hydrocarbons, alicyclic hydrocarbons, aromatic hydrocarbons and halogenated products of those hydrocarbons. Specific examples thereof include octane, isooctane, decane, isodecane, decaline, nonane, dodecane, isododecane, cyclohexane, cyclooctane, cyclodecane, benzene, toluene, xylene, mesitylene, Isopar E, Isopar G, Isopar H and Isopar L (Isopar: trade name, products of Exxon Corp.), Shellsol 70 and Shellsol 71 (Shellsol: trade name, products of Shell Oil Corp.), and Amsco OMS and Amsco 460 solvent (Amusco: trade name, products of American Mineral Spirits Corp.). They can be used individually or as a mixture of two or more thereof. As to the nonaqueous solvent, the upper limit of the electric resistance value is of the order of $10^{16}$ Ω·cm, and the lower limit of the dielectric constant values is about 1.8.

When the electric resistance of the nonaqueous solvent used is too low beyond the foregoing range, the resulting ink cannot have an appropriate electric resistance, so that the ejection of ink by the action of an electric field becomes poor. On the other hand, when the dielectric constant of the nonaqueous solvent used is too high beyond the foregoing range, the electric field is apt to be relaxed in the ink, and thereby poor ejection of the ink tends to occur.

The resin particles dispersed in the nonaqueous solvent as described above are hydrophobic resin particles which are solid at temperature of 35° C. or below and have good affinity with the nonaqueous solvent. As such a hydrophobic resin, a resin (P) having a glass transition temperature of −5° C. to 110° C. or a softening temperature of 33° C. to 140° C. is preferred. The more preferable range of the glass transition temperature is from 10° C. to 100° C. and that of the softening temperature is from 38° C. to 120° C. In particular, it is preferred for the resin (P) to have a glass transition temperature of 15° C. to 80° C. or a softening temperature of 38° C. to 100° C.

By using a resin having such a glass transition temperature or a softening temperature as described above, the affinity of each resin particle with the surface of the image-receiving layer is enhanced and the resin particles are firmly bonded to one another on the printing plate precursor. Thus, the adhesion of the ink image to the image-receiving layer is increased and the press life is improved. On the contrary, if the glass transition temperature or a softening temperature of the resin used is beyond the upper and lower limits specified above, the affinity of each resin particle with the image-receiving layer surface is lowered and the bond between resin particles is weakened.

The weight average molecular weight (Mw) of the resin (P) is preferably from $1\times10^3$ to $1\times10^6$, more preferably from $5\times10^3$ to $8\times10^5$, and yet more preferably from $1\times10^4$ to $5\times10^5$.

Examples of such a resin (P) include olefin homopolymers and copolymers (such as polyethylene, polypropylene, polyisobutylene, ethylene-vinyl acetate copolymer, ethylene-acrylate copolymer, ethylene-methacrylate copolymer and ethylene-methacrylic acid copolymer), vinyl chloride homopolymers or copolymers (such as polyvinyl chloride and vinyl chloride-vinyl acetate copolymer), vinylidene chloride copolymers, vinyl alkanoate homopolymers and copolymers, allyl alkanoate homopolymers and copolymers, homopolymers and copolymers of styrene and derivatives thereof (such as butadiene-styrene copolymer, isoprene-styrene copolymer, styrene-methacrylate copolymer and styrene-acrylate copolymer), acrylonitrile copolymers, methacrylonitrile copolymers, alkyl vinyl ether copolymers, acrylate homopolymers and copolymers, methacrylate homopolymers and copolymers, itaconic acid diester homopolymers and copolymers, maleic anhydride copolymers, acrylamide copolymers, methacrylamide copolymers, phenol resins, alkyd resins, polycarbonate resins, ketone resins, polyester resins, silicone resins, amide resins, hydroxyl and carboxyl-modified polyester resins, butyral resins, polyvinyl acetal resins, urethane resins, rosin resins, hydrogenated rosin resins, petroleum resins, hydrogenated petroleum resins, maleic acid resins, terpene resins, hydrogenated terpene resins, chroman-indene resins, cyclized rubber-methacrylate copolymers, cyclized rubber-acrylate copolymers, copolymers containing a heterocyclic ring containing no nitrogen atom (as the heterocyclic ring, e.g., furan ring, tetrahydrofuran ring, thiophene ring, dioxane ring, dioxofuran ring, lactone ring, benzofuran ring, benzothiophene ring and 1,3-dioxetane ring), and epoxy resins.

It is desirable for the resin particles to be contained in the oil-based ink in an amount of from 0.5 to 20% by weight based on the total ink. When the amount of the resin particles is lower than 0.5% by weight, it becomes hard for the ink to have an affinity with the image-receiving layer of the printing plate precursor and as a result, the ink cannot form images of good quality and the press life decreases. When the proportion is increased beyond the foregoing range, on the other hand, it is difficult to form a homogeneous dispersion and as a result, the ink is apt to clog an ejection head and stable ink ejection may not be achieved.

For the oil-based ink used in the present invention, it is preferred to contain a coloring material together with the resin particles so that the coloring material makes the ink image area opaque when the printing plate precursor is irradiated with ultraviolet light for making the non-image area hydrophilic.

Such a coloring material may be any of pigments and dyes which have been conventionally used in oil-based ink compositions and liquid developers for electrostatic photography.

The pigments have no particular restriction, and include both inorganic and organic pigments which are ordinarily used in the printing field. Examples of pigment usable in the oil-based ink include carbon black, cadmium red, molybdenum red, chrome yellow, cadmium yellow, titanium yellow, chromium oxide, viridian, titanium cobalt green, ultramarine blue, Prussian blue, cobalt blue, azo pigments, phthalocyanine pigments, quinacridone pigments, isoindolinone pigments, dioxazine pigments, threne pigments, perylene pigments, perynone pigments, thioindigo pigments, quinophthalone pigments and metal complex pigments.

As the dyes, oil-soluble dyes are suitable for the oil-based ink, with examples including azo dyes, metal complex dyes, naphthol dyes, anthraquinone dyes, indigo dyes, carbonium dyes, quinoneimine dyes, xanthene dyes, cyanine dyes, quinoline dyes, nitro dyes, nitroso dyes, benzoquinone dyes, naphthoquinone dyes, phthalocyanine dyes and metallophthalocyanine dyes.

The pigments and dyes may be used individually, or they can be used in an appropriate combinations. It is desirable that they are contained in a proportion of from 0.01 to 5% by weight based on the total ink.

Such a coloring material as described above may be dispersed into the nonaqueous solvent as a dispersed particle separately from the resin particles, or it may be incorporated into the resin particles dispersed in the nonaqueous solvent. In the latter case, the incorporation of a pigment is ordinarily effected by coating the pigment with the resin material of resin particles to form resin-coated particles, while the incorporation of a dye is ordinarily effected by coloring the surface part of resin particles with the dye to form colored particles.

The average diameter of the resin particles, including colored particles, dispersed in the nonaqueous solvent is preferably from 0.10 to 1 $\mu$m, more preferably from 0.15 to 0.8 $\mu$m. The diameter of the particle is determined with a particle size analyzer, CAPA-500 (trade name, manufactured by Horiba Ltd.).

The nonaqueous dispersion of resin particles used in the present invention can be prepared using a well-known mechanical grinding method or a polymerization granulation method. In the mechanical grinding method, the materials for forming resin particles are mixed, molten and kneaded, if needed, and directly ground into fine particles with a conventional grinder, and further dispersed in the presence of a dispersing polymer by means of a conventional wet-type dispersing machine (e.g., a ball mill, a paint shaker, a Keddy mill, a Dyno mill). In another mechanical grinding method, the materials for forming resin particles and a dispersion assisting polymer (a covering polymer) are kneaded in advance to form a kneaded matter, then ground into fine particles, and further dispersed in the presence of a dispersion polymer. Methods of preparing paints or liquid developers for electrostatic photography can be adopted in practice. Details of these methods are described, e.g., in *Flow of Paints and Dispersion of Pigments*, translated under the supervision of Kenji Ueki, Kyoritsu Shuppan (1971), Solomon, *Paint Science, Paint and Surface coating and Theory and Practice*, Yuji Harasaki, *Coating Engineering*, Asakura Shoten (1971), and Yuji Harasaki, *Elementary Course of Coating Science*, Maki Shoten (1977).

As the polymerization granulation method, well-known methods for dispersion polymerization in nonaqueous media can be employed. Details of such methods are described, e.g., in *The Newest Technology of Super-fine Polymer Particles*, chapter 2, edited under the supervision of Soichi Muroi, CMC Shuppan (1991), *The Latest Systems for Electrophotographic Development, and Development and Application of Toner Materials*, chapter 3, edited by Koichi Nakamura, Nippon Kagaku Joho K.K. (1985), and K. B. J. Barrett, *Dispersion Polymerization in Organic Medium*, John Wiley (1976).

In order to stabilize the particles dispersed in a nonaqueous medium, the particles are generally dispersed together with a dispersing polymer (also referred to as dispersion stabilizing resin hereinafter sometimes) (PS). The dispersing polymer (PS) contains repeating units soluble in the nonaqueous medium as the main component, and weight average molecular weight (Mw) thereof is preferably from $1\times10^3$ to $1\times10^6$, more preferably from $5\times10^3$ to $5\times10^5$ Suitable examples of soluble repeating units of a dispersing polymer (PS) usable in the present invention include a polymerizing component represented by formula (III):

(III)

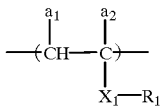

wherein $X_1$ represents —COO—, —OCO— or —O—; $R_1$ represents an alkyl or alkenyl group having from 10 to 32 carbon atoms, preferably an alkyl or alkenyl group having from 10 to 22 carbon atoms, which may have a straight chain or branched structure and may be substituted, although the unsubstituted form is preferred (e.g., decyl, dodecyl, tridecyl, tetradecyl, hexadecyl, octadecyl, eicosanyl, docosanyl, decenyl, dodecenyl, tridecenyl, hexadecenyl, octadecenyl or linoleyl); and $a^1$ and $a^2$, which may be the same or different, each preferably represent a hydrogen atom, a halogen atom (e.g., chlorine or bromine), a cyano group, an alkyl group having from 1 to 3 carbon atoms (e.g., methyl, ethyl or propyl), —COO—$Z^1$ or —$CH_2$COO—$Z^1$ [wherein $Z^1$ represents a hydrocarbon group having not more than 22 carbon atoms which may be substituted (such as an alkyl, alkenyl, aralkyl, alicyclic or aryl group) including an unsubstituted or substituted alkyl group having from 1 to 22 carbon atoms (e.g., methyl, ethyl, propyl, butyl, heptyl, hexyl, octyl, nonyl, decyl, dodecyl, tridecyl, tetradecyl, hexadecyl, octadecyl, eicosanyl, docosanyl, 2-chloroethyl, 2-bromoethyl, 2-methoxycarbonylethyl or 2-methoxyethy), an unsubstituted or substituted alkenyl group having from 4 to 18 carbon atoms (e.g., 2-methyl-1-propenyl, 2-butenyl, 2-pentenyl, 3-methyl-2-pentenyl, 1-pentenyl, 1-hexenyl, 2-hexenyl, 4-methyl-2-hexenyl, decenyl, dodecenyl, tridecenyl, hexadecenyl, octadecenyl or linoleyl), an unsubstituted or substituted aralkyl group having from 7 to 12 carbon atoms (e.g., benzyl, phenetyl, 3-phenylpropyl, naphthylmethyl, 2-naphthylethyl, chlorobenzyl, bromobenzyl, methylbenzyl, ethylbenzyl, methoxybenzyl, dimethylbenzyl or dimethoxybenzyl), an unsubstituted or substituted alicyclic group having from 5 to 8 carbon atoms (e.g., cyclohexyl, 2-cyclohexylethyl or 2-cyclopentylethyl) and an unsubstituted or substituted aromatic group having from 6 to 12 carbon atoms (e.g., phenyl, naphthyl, tolyl, propylphenyl, butylphenyl, octylphenyl, methoxyphenyl, chlorophenyl, bromophenyl, acetylphenyl, methoxycarbonylphenyl, ethoxycarbonylphenyl or propionamidophenyl)].

In addition to the repeating unit represented by formula (III), the dispersing polymer (PS) may contain other repeating units as copolymerizing components. The copolymerizing components may be derived from any monomers as far as they can be copolymerized with the monomers corresponding to the repeating units of formula (III).

The suitable proportion of the repeating unit represented by formula (III) in the dispersing polymer (PS) is preferably at least 50% by weight, more preferably at least 60% by weight.

Examples of such a dispersing polymer (PS) include the polymers described, e.g., in JP-A-10-204354, JP-A-10-204356, JP-A-10-259336, JP-A-10-306244, JP-A-10-316917, JP-A-10-316920 and JP-B-6-40229 (the term "JP-B" as used herein means an "examined Japanese patent publication"), but the present invention should not be construed as being limited thereto.

In preparing the foregoing resin (P) particles in the state of an emulsion (latex), it is preferred that the dispersing polymer (PS) is added prior to the polymerization.

In the case of using a dispersing polymer (PS), the proportion of the dispersing polymer in the total ink is from about 0.05 to about 4% by weight.

In the oil-based ink employed in the present invention, it is desirable that the dispersed resin particles and colored particles (the particles of coloring material) be positively or negatively charged electroscopic particles.

In order to impart the electroscopicity to those particles, the technology of a wet developer for electrostatic photography can be appropriately utilized. Specifically, the electroscopicity can be imparted to the particles by using electroscopic materials, for example, charge control agents and other additives as described, e.g., in *The Latest Systems for Electrophotographic Development System, and Development and Application of Toner Materials*, pp. 139–148, *The Fundamentals and Applications of Electrophotographic Techniques*, edited by Electrophotographic Society, pp. 497–505, Corona Co. (1988), and Yuji Harasaki, *Electrophotography*, vol. 16 (No.2), p. 44 (1977).

In addition, details of those materials are described, e.g., in British Patents 893,429 and 934,038, U.S. Pat. Nos. 1,122,397, 3,900,412 and 4,606,989, JP-A-60-179751, JP-A-60-185963 and JP-A-2-13965.

The charge control agent as described above is preferably used in an amount of 0.001 to 1.0 parts by weight per 1,000 parts by weight of dispersing medium as a carrier liquid. Furthermore, various kinds of additives can be added, but the total amount of additives has an upper limit because it is restricted by the electric resistance allowable for the oil-based ink used in the present invention. More specifically, when the ink has an electric resistance of lower than $10^9$ Ω·cm in the condition that the dispersed particles are removed from the ink, the formation of a continuous gradation image having good quality may become difficult. Therefore, it is required that the amount of each additive added be controlled within the above described limitation.

A method for forming images on the lithographic printing plate precursor (also referred to as "master" hereinafter) according to the present invention using an ink jet recording system is described in more detail below. One example of a device system suitable for performing such a method is shown in FIG. 1.

The device system shown in FIG. 1 comprises an ink jet recording device 1 wherein an oil-based ink is used.

As shown in FIG. 1, pattern information of images (figures and letters) to be formed on a master 2 is first supplied from an information supply source such as a computer 3, to the ink jet recording device 1 using oil-based ink through a transmission means such as a bus 4. A head for ink jet recording 10 of the recording device 1 stores oil-based ink inside. When the master 2 is passed through the recording device 1, the head 10 ejects fine droplets of the ink onto the master 2 in accordance with the foregoing information, whereby the ink is attached to the master 2 in the foregoing pattern. Thus, the image formation on the master 2 is completed, and the lithographic printing plate precursor having the images thereon is obtained.

Figure 2:
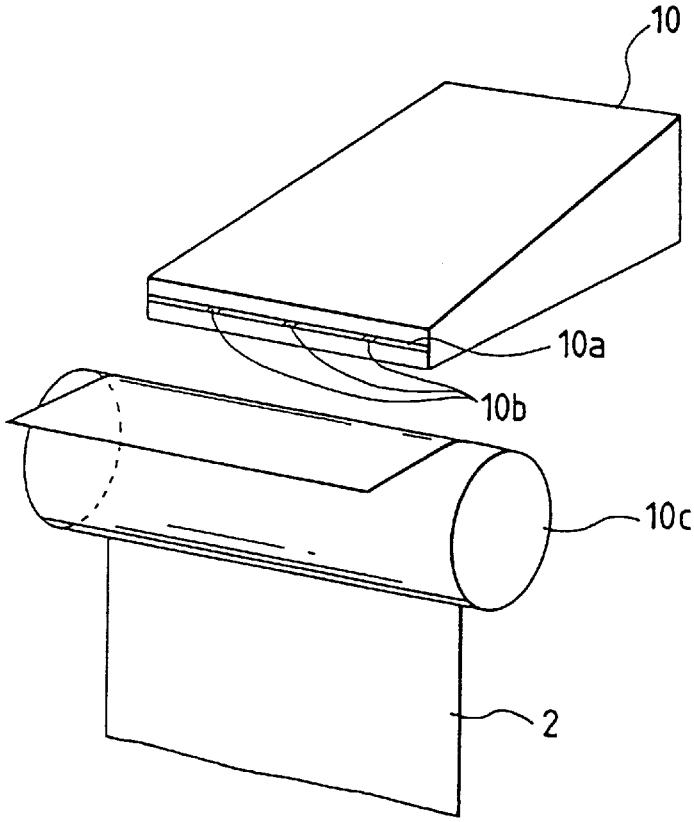
FIG. 2 is a schematic view showing the main part of an ink jet recording device used in the present invention.
Figure 3:
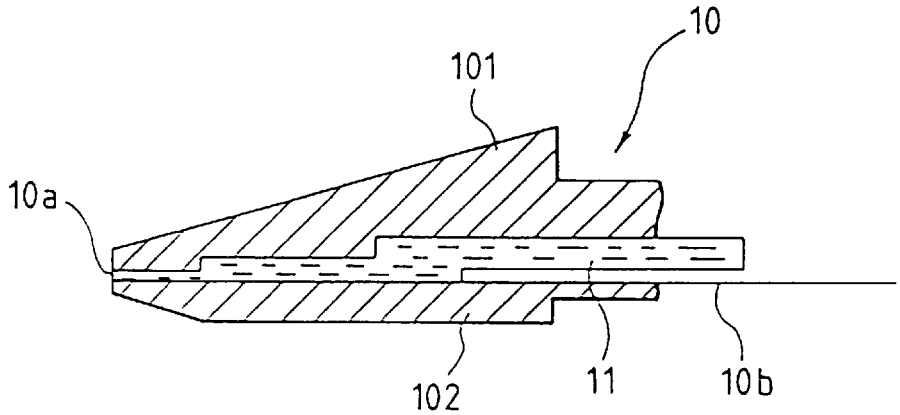
FIG. 3 is a partially cross sectional view of a head of an ink jet recording device used in the present invention.

Components of the ink jet recording device as shown in the device system of FIG. 1 are shown in FIG. 2 and FIG. 3, respectively. In FIG. 2 and FIG. 3, members common to the members in FIG. 1 are designated using the same symbols, respectively.

FIG. 2 is a schematic view showing the main part of the ink jet recording device, and FIG. 3 is a partially cross sectional view of the head.

As shown in FIG. 2 and FIG. 3, the head 10 attached to the ink jet recording device has a slit between an upper unit 101 and a lower unit 102, a leading edge thereof forms an ejection slit 10*a*. Further, an ejection electrode 10*b* is arrange in the slit, and the interior of the slit is filled with oil-based ink 11.

To the ejection electrode 10*b* of the head 10, voltage is applied in accordance with digital signals from the pattern information of image. As shown in FIG. 2, a counter electrode 10*c* is arranged so as to face with the ejection electrode 10*b*, and the master 2 is provided on the counter electrode 10*c*. By the application of the voltage, a circuit is formed between the ejection electrode 10*b* and the counter electrode 10*c*, and the oil-based ink 11 is ejected from the ejection slit 10*a* of the head 10, thereby forming images on the master 2 provided on the counter electrode 10*c*.

With respect to the width of the ejection electrode 10*b*, it is preferred for the leading edge thereof to be as narrow as possible in order to form images of high quality.

For instance, print of 40 μm-dot can be formed on the master 2 by filling the head 10 as shown in FIG. 3 with the oil-based ink, disposing the ejection electrode 10*b* having a leading edge having a width of 20 μm and the counter electrode 10*c* so as to face with each other at a distance of 1.5 mm and applying a voltage of 3 KV for 0.1 millisecond between these two electrodes.

Desensitization with a dry process according to the present invention is described below.

The lithographic printing plate precursor having the colored images is irradiated all over with ultraviolet light, thereby selectively changing the surface condition of only the non-image area to be hydrophilic.

The image area, on the other hand, retains hydrophobic property because the colored images are impermeable to ultraviolet light.

The light source of ultraviolet light used for the irradiation may be any of lamps emitting light having a wavelength of from 300 to 450 nm. In particular, a lamp which enables efficient use of wavelengths of from 350 nm to 420 nm is preferred.

Suitable examples of such a lamp include a mercury lamp, a metal halide lamp and a xenon lamp. The irradiating condition can be appropriately selected as far as the surface of the irradiated area can have a contact angle with water of 15 degrees or below. For instance, the preferable irradiation time is up to about 5 minutes.

Thus, a printing plate which can provide printed matter having clear images free from background stains by offset printing can be prepared.

The lithographic printing plate precursor according to the present invention has an image-receiving layer comprising anatase-type titanium oxide grains and a binder resin comprising a complex composed of an organometallic polymer and an organic polymer containing at least one member selected from the group consisting of an amido bond, a urethane bond, a ureido bond and a hydroxy group, and the contact angle of water with the surface of the image-receiving layer is at least 25 degrees, and the contact angle is changed to 15 degrees or below by irradiation with ultraviolet light. Accordingly, the printing plate precursor can be desensitized in a dry state by irradiation with ultraviolet light, thereby forming a lithographic printing plate which can provide a great number of printed matter having clear images free from background stains.

Further, the platemaking method according to the present invention enables the easy image formation on the printing plate precursor utilizing an electrophotographic recording system, an ink jet recording system or the like and the dry-desensitization utilizing ultraviolet irradiation, and forms a lithographic printing plate which has excellent press life and can provide a great number of printed matter having clear images free from background stains, disappearance, distortion and blurs in the image area.

The present invention will be described in more detail with reference to the following examples, but the present invention is not to be construed as being limited thereto.

EXAMPLE I-1

Preparation of Lithographic Printing Plate Precursor

Coating Composition for Image-Receiving Layer

To 143 g of a 7% by weight aqueous solution of polyvinyl alcohol (PVA-405 produced by Kuraray Co., Ltd.) was added 57 g of methanol with stirring and the mixture was further stirred for 30 minutes. To the mixture was added 10 g of tetramethoxysilane, followed by stirring for 30 minutes, then one ml of concentrated hydrochloric acid was added thereto and the mixture was stirred for 2 hours and further allowed to stand for 24 hours.

To the resulting mixture were added 100 g of a 40% solution of photocatalyst titanium oxide sol (Titanium oxide slurry STS-21 produced by Ishihara Sangyo Kaisha Ltd.) and 48 g of a 20% solution of Alumina sol 520 (produced by Nissan Chemical Industries, Ltd.) and the mixture was stirred for 20 minutes to prepare a dispersion.

A support of ELP-1X Type Master (trade name, produced by Fuji Photo Film Co., Ltd.) having the Bekk smoothness of 900 (sec/10 ml) on the under layer side, which is used as an electrophotographic lithographic printing plate precursor for small-scale commercial printing, was employed. On the support, the coating composition prepared above was coated by means of a wire bar and dried at 110° C. for 20 minutes to form an image-receiving layer having a coating amount of 5 g/m$^2$. Thus, a lithographic printing plate precursor was prepared.

The Bekk smoothness of the surface of the printing plate precursor was 800 (sec/10 ml), which was measured using a Bekk smoothness tester (produced by Kumagai Riko Co., Ltd.) under a condition that the air volume was 10 ml as described hereinbefore.

Further, 2 $\mu$l of distilled water was put on the surface of the printing plate precursor, and after a 30-second lapse the contact angle of the water with the printing plate precursor surface was measured with a surface contact angle meter (CA-D, trade name, produced by Kyowa Kaimen Kagaku Co., Ltd.) as described hereinbefore. The measured value was 50 degrees.

An electrophotographic light-sensitive element prepared in the manner described below was subjected to corona discharge in the dark to gain the surface potential of +450 V, and then to scanning-exposure using a 788 mm semiconductor laser beam-utilized drawing device as an exposure apparatus. The laser beam scanning was performed on the basis of image information which was obtained by previously reading an original with a color scanner, subjecting the read image information to color separation, making some corrections relating to color reproduction of the system used, and then memorizing the corrected image information as digital image data in the internal hard disk of the system. As to the laser beam scanning condition, the beam spot diameter was 15 $\mu$m, the pitch was 10 $\mu$m and the scanning speed was 300 cm/sec (i.e., 2,500 dpi). The amount of exposure on the light-sensitive element was adjusted to 25 erg/cm$^2$.

Electrophotographic Light-Sensitive Element

A mixture of 2 g of X-type metal-free phthalocyanine (produced by Dai—Nippon Ink & Chemicals Inc.), 14.4 g of Binder Resin (P-1) shown below, 3.6 g of Binder Resin (P-2) shown below, 0.15 g of Compound (A) shown below and 80 g of cyclohexanone was placed together with glass beads in a 500 ml of glass vessel, and dispersed for 60 minutes by a paint shaker (produced by Toyo Seiki Seisakusho). Then, the glass beads was removed by filtration to prepare a dispersion for light-sensitive layer.

Binder Resin (P-1)

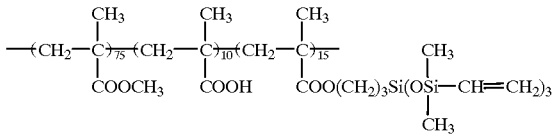

Mw: 6×10$^4$

Binder Resin (P-2)

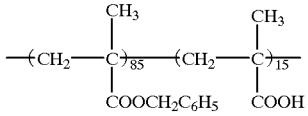

Mw: 8×10$^3$

Compound (A)

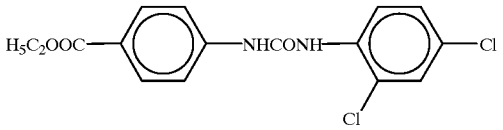

The dispersion thus prepared was coated on a 0.2 mm-thick degreased aluminum plate by means of a wire bar, set to touch, and then heated for 20 seconds in a circulation type oven regulated at 110° C. The thus-formed light-sensitive layer had a thickness of 8 $\mu$m.

Subsequently, the light-sensitive element exposed in the foregoing manner was developed with a liquid developer shown below, rinsed in a bath of Isopar G alone to remove stains in the non-image area, and dried with a hot air so that the light-sensitive element had a surface temperature of 50° C. and the amount of residual Isopar G was reduced to 10 mg per mg of the toner. Then, the light-sensitive element was subjected to −6 KV precharge with a corona charging device, and the image side of the light-sensitive element was brought into face-to-face contact with the foregoing lithographic printing plate precursor and underwent negative corona discharge on the side of the light-sensitive element, thereby performing the image transfer.

Liquid Developer

The following ingredients were mixed and kneaded for 2 hours at 95° C. by means of a kneader to prepare a mixture. The mixture was cooled inside the kneader, and ground to powder therein. The powder in an amount of 1 parts by weight and Isopar H in an amount of 4 parts by weight were dispersed for 6 hours by a paint shaker to prepare a dispersion. The resulting dispersion was diluted with Isopar G so as to have a solid toner content of 1 g per liter and, as a charge control agent for imparting a negative charge, basic barium petronate was added thereto in an amount of 0.1 g per liter. Thus, a liquid developer was prepared.

Ingredients to be Kneaded

| | |
|---|---|
| Ethylene-methacrylic acid copolymer, Nucrel N-699 (produced by Mitsui Du Pont Co.) | 3 parts by weight |
| Carbon Black #30 (produced by Mitsubishi Chemical Industries Ltd.) | 1 parts by weight |
| Isopar L (produced by Exxon Corp.) | 12 parts by weight |

The image-formed lithographic printing plate precursor was heated at 100° C. for 30 seconds, thereby fixing completely the toner image.

The images formed on the printing plate precursor were observed under an optical microscope of 200 magnifications, and the image quality was evaluated. As a result, the images obtained were clear free from blurs or disappearance of fine lines and fine letters.

Then, the printing plate precursor was exposed to light for 3 minutes by means of a 100 W high-pressure mercury lamp placed in a distance of 10 cm.

The surface wettabilities of the non-image area and the image area (solid image area) of the thus obtained lithographic printing plate were evaluated by the contact angle with water. The contact angle of water with the surface of the non-image area was changed to 8 degrees, and that of the image area was 90 degrees.

Then, the lithographic printing plate was mounted in a printing machine (Oliver Model 94, produced by Sakurai Seisakusho K.K.), and printing was performed on sheets of printing paper using black ink for offset printing and dampening water prepared by diluting SLM-OD (produced by Mitsubishi Paper Mills, Ltd.) 100 times with distilled water and placed in a dampening saucer.

The 10th printed matter was picked in the course of printing, and the images thereon were evaluated by visual observation using a magnifier of 20 magnifications. The observation result indicated that the non-image area was free from background stains due to adhesion of the printing ink and the uniformity of the solid image area was highly satisfactory. Further, the printed matter was observed under an optical microscope of 200 magnifications. According to the observation, neither sharpening nor disappearance were found in the areas of fine lines and fine letters, and the image quality of printed matter was excellent.

As a result of the printing, more than 3,000 sheets of printed matter having image quality equal to that of the 10th print were obtained.

EXAMPLE I-2

Preparation of Water-Resistant Support

Wood free paper having a basis weight of 100 g/m$^2$ was used as a substrate, and the coating composition for a backcoat layer shown below was coated on one side of the substrate by means of a wire bar to form a backcoat layer having a dry coating amount of 12 g/m$^2$. Then, the backcoat layer was subjected to a calender treatment so as to have Bekk smoothness of about 500 (sec/10 ml).

Coating Composition for Backcoat Layer

| | |
|---|---|
| Kaolin (50% aqueous dispersion) | 200 parts |
| Polyvinyl alcohol (10% aqueous solution) | 60 parts |
| SBR latex (solid content: 50%, Tg: 0° C.) | 100 parts |
| Melamine resin (solid content: 80%, Sumirez Resin SR-613) | 5 parts |

On the other side of the substrate, the coating composition for an under layer, which had one of the formulae I-A to I-G shown in Table I-1 below, was coated by means of a wire bar to form an under layer having a dry coating amount of 10 g/m$^2$. Then, the under layer was subjected to a calender treatment so as to have the Bekk smoothness of about 1,500 (sec/10 ml). The thus prepared seven samples of water-resistant support were referred to as support samples No. 01 to No. 07 corresponding to the composition formulae I-A to I-G respectively, as shown in Table I-1.

TABLE I-1

| | Composition | | | | |
|---|---|---|---|---|---|
| Formula | Carbon Black | Clay | SBR Latex | Melamine Resin | Support Sample No. |
| I-A | 0 | 5 | 36 | 4 | 01 |
| I-B | 0 | 60 | 36 | 4 | 02 |
| I-C | 3 | 57 | 36 | 4 | 03 |
| I-D | 5.4 | 54.6 | 36 | 4 | 04 |
| I-E | 7.2 | 52.8 | 36 | 4 | 05 |
| I-F | 12 | 51 | 36 | 4 | 06 |
| I-G | 18 | 45 | 36 | 4 | 07 |

The figures in the above table are the solid contents of ingredients, expressed in % by weight, in each composition.

Coating Composition for Under Layer

Carbon black (30% aqueous dispersion)

Clay (50% aqueous dispersion)

SBR latex (solids content: 50%, Tg: 25° C.)

Melamine resin (solids content: 80%, Sumirez Resin SR-613)

Each set of ingredients were mixed in accordance with its corresponding formula shown in Table I-1, and further admixed with water so as to have a total solid concentration of 25%. Thus, the coating compositions I-A to I-G for the under layer were obtained.

The measurement of specific electric resistance of each under layer was carried out in the following manner.

Each of the coating compositions I-A to I-G was applied to a thoroughly degreased and cleaned stainless steel plate at a dry coating amount of 10 g/m$^2$ to form a coating film. The thus formed seven samples of coating films were each examined for specific electric resistance in accordance with a three-terminal method with a guard electrode according to the method described in JIS K-6911. The results are shown in Table I-2.

TABLE I-2

| Under Layer | Specific Electric Resistance (Ω · cm) |
|---|---|
| I-A | $1 \times 10^{14}$ |
| I-B | $2 \times 10^{12}$ |
| I-C | $1 \times 10^{11}$ |
| I-D | $4 \times 10^{9}$ |
| I-E | $1 \times 10^{8}$ |
| I-F | $8 \times 10^{3}$ |
| I-G | $4 \times 10^{3}$ |

Preparation of Lithographic Printing Plates Precursor

The dispersion having the composition shown below was coated on each of the support samples No. 01 to No. 07 at a dry coating amount of 5 g/m$^2$ to form an image-receiving layer, thereby preparing lithographic printing plate precursors. Each printing plate precursor surface had the Bekk smoothness of 100 to 115 (sec/10 ml) and the contact angle of water therewith was 55 degrees.

Coating Composition for Image-Receiving Layer

The following composition was placed together with glass beads in a paint shaker (produced by Toyo Seiki K.K.), and dispersed for 6 minutes. Thereafter, the glass beads were removed by filtration and a dispersion was obtained.

| | |
|---|---|
| Photocatalyst titanium oxide powder (ST-01 produced by Ishihara Sangyo Kaisha Ltd.) | 45 g |
| Colloidal silica (20% solution, Snowtex C produced by Nissan Chemical Industries, Ltd.) | 25 g |
| Complex for binder resin shown below | 138.5 g |
| Water | 250 g |

Complex for binder resin:

To 100 g of a 10% by weight aqueous solution of succinic acid-modified starch (PENON-F3 produced by Nichiden Chemical Co., Ltd.) was added 28.5 g of methanol and the mixture was stirred for 30 minutes. To the mixture was added 10 g of tetraethoxysilane, followed by stirring for 30 minutes, then one ml of concentrated hydrochloric acid was added thereto and the mixture was stirred for 6 hours and further allowed to stand for 24 hours.

The lithographic printing plate precursor Specimen Nos. I-1 to I-7 prepared in the above described manner were each subjected to image formation by a laser printer (Xante Plate Maker-8200 J) using a dry toner.

Subsequently, each printing plate precursor was irradiated with ultraviolet light for 3 minutes with the same light source as used in Example I-1 which was placed in a distance of 20 cm. Thus, lithographic printing plates were prepared.

The contact angles of water with the non-image area and the image area of each lithographic printing plate were 5 degrees and 90 degrees, respectively.

Then, each of the lithographic printing plates was mounted in an automatic printing machine (AM-2850, trade name, produced by AM Co. Ltd.), and printing was performed using black ink for offset printing and dampening water prepared by diluting SLM-OD 50 times with distilled water and placed in a dampening saucer.

Each of the lithographic printing plates was examined for image quality of printing plate, image quality of printed matter therefrom (print quality) and press life. The following criteria were employed for evaluating those qualities.

1) Image quality of printing plate:

The images of each lithographic printing plate were observed using an optical microscope of 200 magnifications, and the image quality was evaluated. The capital letters E, G, M and B in Table I-3 below represent the following states, respectively.

E: The images are very clear, and even fine lines and fine letters have excellent quality.

G: The images are clear, and even fine lines and fine letters have good quality.

M: There is slight image disappearance in the areas of fine lines and fine letters.

B: There are image disappearance in the areas of fine lines and fine letters and clear spots in the solid image area, so the image quality is bad.

2) Image quality of printed matter:

The quality of images on each printed matter obtained from each lithographic printing plate was evaluated in the same manner as in the above item 1). The capital letters E, G, M and B in Table I-3 represent that the printed matter is in the same states as described above, respectively.

3) Press life:

The press life is expressed in terms of the number of printed matter obtained until background stains or disappearance of image was visually observed on the printed matter.

The results are shown in Table I-3 below.

TABLE I-3

| Specimen No. | Support Sample | Image Quality of Printing Plate | Image Quality of Printed Matter | Press Life |
|---|---|---|---|---|
| I-1 | No. 01 | M | M | 1,500 |
| I-2 | No. 02 | E | E | 1,500 |
| I-3 | No. 03 | E | E | 1,500 |
| I-4 | No. 04 | E | E | 1,500 |
| I-5 | No. 05 | E | E | 1,500 |
| I-6 | No. 06 | M - B | B | 300 |
| I-7 | No. 07 | M - B | B | 300 |

The results shown in Table I-3 are considered in some detail with reference to the values of specific electric resistance shown in Table I-2.

In Specimen Nos. I-2 to I-5, the under layer of each support had a specific electric resistance of about $10^{12}$ to $10^{8}$ Ω·cm. The images formed were very clear, even fine lines and fine letters had excellent quality, and the press life was good.

On the other hand, in Specimen No. I-1, the under layer had specific electric resistance of not less than $10^{14}$ Ω·cm and in Specimen Nos. I-6 and I-7, the under layer each had specific electric resistance of less than $10^{4}$ Ω·cm. In these specimen, disappearance of fine line and fine letters and clear spots in the solid image area were observed.

In other words, the results obtained indicate that the image quality of printing plate and the image quality of printed matter are better when the conductivity of the under layer provided just under the image-receiving layer is in a certain range.

EXAMPLE I-3

Preparation of Lithographic Printing Plate Precursor

Coating Composition for Image-receiving Layer

The following composition was placed together with glass beads in a paint shaker (produced by Toyo Seiki K.K.) and dispersed for 5 minutes. Then, the glass beads were removed by filtration to obtain a dispersion.

| | |
|---|---|
| 30% Aqueous solution of photocatalyst titanium oxide sol (STS-02 produced by Ishihara Sangyo Kaisha Ltd.) | 150 g |
| Colloidal silica (Snowtex C) | 25 g |
| Complex for binder resin shown below | whole amount |

Complex for binder resin:

To a mixture of 120 g of a 10% aqueous solution of polyethylene glycol 20000 (produced by Wako Pure Chemical Industries, Ltd.) and 30 g of methanol were added with stirring 6 g of tetraethoxysilane and 2 g of methyltrimethoxysilane, followed by stirring for 30 minutes, then one ml of concentrated hydrochloric acid was added thereto and the mixture was stirred for 4 hours and further allowed to stand overnight.

On the same water-resistant support as used in Example I-1, the coating composition described above was coated by means of a wire bar and dried at 130° C. for 60 minutes to form an image-receiving layer having a coating amount of 4 g/m$^2$. Thus, a lithographic printing plate precursor was prepared. The Bekk smoothness of the surface of the image-receiving layer was 850 (sec/10 ml) and the contact angle with water thereof was 75 degrees.

The printing plate precursor was subjected to the image formation, transfer, fixing and irradiation with ultraviolet light in the same manner as in Example I-1 to prepare a lithographic printing plate and the offset printing was conducted in the same manner as in Example I-1.

The printed matter obtained had clear images without background stains similar to those obtained in Example I-1, and press life was good as more than 3,000.

EXAMPLE I-4

Preparation of Lithographic Printing Plate Precursor

Coating Composition for Image-receiving Layer

The following composition was dispersed using a homogenizer(produced by Nippon Seiki K.K.) at a rotation of 10,000 r.p.m. for 30 minutes to obtain a dispersion.

| | |
|---|---|
| Photocatalyst titanium oxide powder (ST-21) | 50 g |
| Polyamine (Epomin SPO12 produced by Nippon Shokubai Co., Ltd.) | 0.8 g |
| Complex for binder resin shown below | whole amount |
| Water | 250 g |

Complex for binder resin:

To a mixture of 40 g of a 15% aqueous solution of polyethylene glycol having epoxy groups at both terminals thereof (Epolight 400E produced by Kyoeisha Chemical Co., Ltd.) and 60 g of methanol were added 10 g of methyltrimethoxysilane, followed by stirring for 30 minutes, then 2 ml of 1N hydrochloric acid was added thereto and the mixture was stirred for one hour and further allowed to stand for 6 hours.

On the same water-resistant support as Support Sample No. 04 used in Example I-2, the coating composition described above was coated by means of a wire bar and dried to form an image-receiving layer having a coating amount of 5 g/m$^2$. Thus, a lithographic printing plate precursor was prepared. The Bekk smoothness of the surface of the image-receiving layer was 650 (sec/10 ml) and the contact angle with water thereof was 85 degrees.

The printing plate precursor was subjected to the image formation, transfer and fixing in the same manner as in Example I-1.

The printing plate precursor bearing the images was all over exposed to light for 5 minutes by means of a 150 W xenon lump placed in a distance of 10 cm to prepare a lithographic printing plate. The contact angle with water of the surface of the non-image area was 6 degrees and that of the image area was 95 degrees.

Using the printing plate, offset printing was conducted in the same manner as in Example I-1.

The printed matter obtained had clear images without background stains similar to those obtained in Example I-1, and press life was good as more than 3,000.

EXAMPLE I-5

Preparation of Lithographic Printing Plate Precursor

Coating Composition for Image-receiving Layer

The following composition was placed together with glass beads in a paint shaker (produced by Toyo Seiki K.K.) and dispersed for 10 minutes. Then, the glass beads were removed by filtration to obtain a dispersion.

| | |
|---|---|
| Photocatalyst titanium oxide powder (ST-01) | 45 g |
| 20% Solution of Alumina sol 520 | 25 g |
| Complex for binder resin shown below | whole amount |
| Water | 230 g |

Complex for binder resin:

To 50 g of a 10% tetrahydrofuran solution of poly(N-butanoylethyleneimine) was added 30 g of methanol and the mixture stirred for 10 minutes. To the mixture were added 5 g of methyltrimethoxysilane and 2.5 g of 3-sulfopropyltrimethoxysilane, followed by stirring for 30 minutes, then 3 ml of 1N hydrochloric acid was added thereto and the mixture was stirred for 4 hours and further allowed to stand for 24 hours.

The coating composition described above was coated on a degreased aluminum plate having a thickness of 150 μm by means of a wire bar and dried at 110° C. for 20 minutes to form an image-receiving layer having a coating amount of 3 g/m$^2$. Thus, a lithographic printing plate precursor was prepared. The Bekk smoothness of the surface of the image-receiving layer was 900 (sec/10 ml) and the contact angle with water thereof was 45 degrees.

The printing plate precursor was subjected to the image formation, transfer, fixing and irradiation with ultraviolet light in the same manner as in Example I-1 to prepare a lithographic printing plate and the offset printing was conducted in the same manner as in Example I-1.

The printed matter obtained had clear images without background stains similar to those obtained in Example I-1, and press life was good as more than 10,000.

EXAMPLE I-6

Preparation of Lithographic Printing Plate Precursor

A lithographic printing plate precursor was prepared in the same manner as in Example I-5 except for using a polyethylene terephthalate film having a thickness of 100 μm subjected to a corona treatment as the water-resistant support.

The printing plate precursor was subjected to the image formation, transfer, fixing and irradiation with ultraviolet light in the same manner as in Example I-5 to prepare a lithographic printing plate and the offset printing was conducted in the same manner as in Example I-5.

The printed matter obtained had clear images without background stains similar to those obtained in Example I-5, and press life was good as more than 10,000.

EXAMPLES I-7 TO I-13

Preparation of Lithographic Printing Plate Precursor

Each lithographic printing plate precursor was prepared in the same manner as in Example I-1 except for using each compound shown in Table I-4 below in place of the polyvinyl alcohol (PVA-405) and tetramethoxysilane employed for forming the complex for binder resin in Example I-1.

The printing plate precursors were subjected to the image formation, transfer, fixing and irradiation with ultraviolet light in the same manner as in Example I-1 to prepare lithographic printing plates and the offset printing was conducted in the same manner as in Example I-1.

The printed matter obtained had clear images without background stains similar to those obtained in Example I-1, and press life was good as more than 3,000.

TABLE I-4

| Example | Organic Polymer | Organometallic Compound (weight ratio) | Contact Angle of Image-Receiving Layer | Contact Angle of Non-Image Area after Irradiation | Contact Angle of Image Area |
|---|---|---|---|---|---|
| I-7 | Polyvinylpyrrolidone | Methyltrimethoxysilane (60%) Tetraethoxysilane (40%) | 65 degrees | 10 degrees or less | 90 degrees |
| I-8 | Propyleneoxide-modified starch (PENON HV-2 produced by Nichiden Chemical Co., Ltd.) | Tetra(2-methoxyethoxy)titanium | 75 degrees | 10 degrees or less | 88 degrees |
| I-9 | Polyvinyl alcohol (saponification degree: 60%) | Zirconium tetra-n-propoxide | 70 degrees | 10 degrees or less | 85 degrees |
| I-10 | N-Methylacrylamide/methyl acrylate (70/30 in weight ratio) copolymer | γ-Mercaptopropyltrimethoxysilane (20%) Tetraethoxysilane (80%) | 85 degrees | 10 degrees or less | 87 degrees |
| I-11 | Gelatin | Ethyltrimethoxysilane (50%) Methyltriethoxysilane (50%) | 75 degrees | 10 degrees or less | 90 degrees |
| I-12 | Hydroxypropylated starch (PENON LD-1 produced by Nichiden Chemical Co., Ltd.) | Allyltris(β-methoxyethoxy)silane | 65 degrees | 10 degrees or less | 88 degrees |
| I-13 | Polyvinyl alcohol (saponification degree: 60%) | Trimethoxysilane | 40 degrees | 10 degrees or less | 91 degrees |

Now, preparation examples of resin particles (PL) suitable for the oil-based ink used in the present invention will be described below.

Preparation Example 1

Preparation of Resin Particles (PL-1)

A solution obtained by mixing 7 g of Dispersion Stabilizing Resin (PS-1) having the structure illustrated below, 100 g of vinyl acetate and 321 g of Isopar H was heated to 75° C. with stirring in a stream of nitrogen, and thereto was added 1.5 g of 2,2'-azobis(isovaleronitrile) (abbreviated as A.I.V.N.) as a polymerization initiator and the resulting mixture was allowed to react for 3 hours. Further, the resulting reaction mixture was admixed with 1.0 g of A.I.V.N., and the reaction was allowed to continue for additional 3 hours. Then, the reaction system was heated to 100° C., and stirred for 2 hours. As a result, the vinyl acetate unreacted was distilled away. After cooling, the reaction product was passed through a 200-mesh nylon cloth. In the polymerization process, the polymerization rate was 93%, and the white dispersion obtained was a highly monodispersed latex having an average particle diameter of 0.42 μm. The average particle diameter was measured with CAPA-500 (produced by Horiba Ltd.) (hereinafter the same).

Dispersion Stabilizing Resin (PS-1)

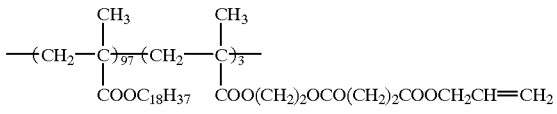

Mw: $4\times10^4$ (composition ratio: by weight)

A part of the foregoing white dispersion was centrifuged (a number of rotations per minute: $1\times10^4$ rpm, a rotation time: 60 minutes), and the thus precipitated resin-particle were collected and dried. The weight average molecular weight (Mw) of the resin-particle was $2\times10^5$ (a GPC value in terms of polystyrene) and the glass transition temperature (Tg) thereof was 38° C.

Preparation Example 2

Preparation of Resin Particles (PL-2)

[Production of Dispersion Stabilizing Resin (PS-2)]

A solution obtained by mixing 100 g of octadecyl methacrylate, 0.6 g of divinylbenzene and 200 g of toluene was heated to 85° C. with stirring in a stream of nitrogen, and thereto was added 4.0 g of 2,2'-azobis(isobutyronitrile) (abbreviated as A.I.B.N.), and the resulting mixture was allowed to react for 4 hours. Further, the reaction mixture was admixed with 1.0 g of A.I.B.N., and the reaction was allowed to continue for 2 hours. Furthermore, the resulting reaction mixture was admixed with 0.5 g of A.I.B.N., and the reaction was allowed to continue for 2 hours. After cooling, the reaction product was poured into 1.5 liter of methanol to separate out a precipitate. The obtained precipitate was collected by filtration and dried. Thus, 88 g of white powder was obtained. The polymer thus-produced has a weight average molecular weight (Mw) of $3.8\times10^4$.

[Preparation of resin particles]

A solution obtained by mixing 12 g of Dispersion Stabilizing Resin PS-2 produced above with 177 g of Isopar H was heated to 70° C. with stirring in a stream of nitrogen. Thereto, a mixture of 30 g of methyl methacrylate, 70 g of methyl acrylate, 200 g of Isopar G and 1.0 g of A.I.V.N. was dropwise added over a 2-hour period, and the resulting solution was stirred for 2 hours as it was. Further, the resulting reaction solution was admixed with 0.5 g of A.I.V.N., and heated to 85° C., followed by stirring for 3 hours. After cooling, the reaction product was passed through a 200-mesh nylon cloth. In the polymerization procedure, the polymerization rate was 100%, and the white dispersion obtained was a latex having an average particle diameter of 0.38 $\mu$m.

The Mw of the thus prepared resin particles was $3\times10^5$, and the Tg thereof was 28° C.

Preparation Example 3

Preparation of Resin Particles (PL-3)

[Production of Dispersion Stabilizing Resin (PS-3)]

A solution obtained by mixing 60 g of octadecyl methacrylate, 40 g of tridecyl acrylate, 3 g of thioglycolic acid, 5.0 g of divinylbenzene and 200 g of toluene was heated to 85° C. with stirring in a stream of nitrogen, and thereto was added 0.8 g of 1,1'-azobis-(cyclohexane-1-carbonitrile) (abbreviated as A.C.H.N.), and the resulting mixture was allowed to react for 4 hours. Further, the reaction mixture was admixed with 0.4 g of A.C.H.N., and the reaction was allowed to continue for 2 hours. Furthermore, the resulting reaction mixture was admixed with 0.2 g of A.C.H.N., and the reaction was allowed to continue for 2 hours. After cooling, the reaction mixture was admixed with 15 g of 2-hydroxyethyl methacrylate, and the temperature thereof was adjusted to 25° C. Thereto, the solution obtained by mixing 16 g of dicyclohexylcarbodiimide (abbreviated as D.C.C.), 0.2 g of 4-(N,N-diethylamino)pyridine and 40 g of methylene chloride was dropwise added over a 1-hour period with stirring. Therein, the reaction was allowed to continue for 3 hours. Thus, the reaction was completed. Then, the reaction mixture thus obtained was admixed with 10 g of 80% formic acid, and stirred for 1 hour. Thereafter, the insoluble matter was filtered off, and the filtrate was poured into 2.5 liter of methanol to separate out a precipitate. The obtained precipitate was collected by filtration, and dissolved in 200 g of toluene. Again, the insoluble matter was filtered off, and the filtrate was poured into 1 liter of methanol to separate out a precipitate. The obtained precipitate was collected by filtration, and dried. Thus, 70 g of a polymer was obtained, and the weight average molecular weight (Mw) thereof was $4.5\times10^4$.

[Preparation of resin particles]

A solution obtained by mixing 8 g of Dispersion Stabilizing Resin PS-3 produced above with 136 g of Isopar H was heated to 60° C. with stirring in a stream of nitrogen. Thereto, a mixture of 50 g of methyl methacrylate, 50 g of ethyl acrylate, 200 g of Isopar G and 1.0 g of A.I.V.N. was dropwise added over a 2-hour period, and the resulting solution was stirred for 2 hours as it was. Further, the resulting reaction solution was admixed with 0.5 g of A.I.V.N., and heated to 80° C., followed by stirring for 3 hours. After cooling, the reaction product was passed through a 200-mesh nylon cloth. In the polymerization procedure, the polymerization rate was 100%, and the white dispersion obtained was a latex having an average particle diameter of 0.40 $\mu$m.

The Mw of the thus prepared resin particles was $3\times10^5$, and the Tg thereof was 30° C.

Preparation Example 4

Preparation of Resin Particles (PL-4)

A solution obtained by mixing 8 g of Dispersion Stabilizing Resin (PS-4) having the structure illustrated below, 95 g of vinyl acetate, 5 g of crotonic acid and 324 g of Isopar H was heated to 70° C. with stirring in a stream of nitrogen, thereto was added 1.5 g of A.I.V.N. as a polymerization initiator, and the solution was allowed to react for 3 hours. Further, the resulting reaction mixture was admixed with 0.8 g of A.I.B.N., heated to 80° C., and the reaction was allowed to continue for additional 3 hours. Furthermore, the reaction mixture was admixed with 0.5 g of A.I.B.N., and the reaction was allowed to continue for 3 hours. After cooling, the reaction product was passed through a 200-mesh nylon cloth. In the polymerization process, the polymerization rate was 98%, and the white dispersion obtained was a highly monodispersed latex having an average particle diameter of 0.47 $\mu$m.

The Mw of the resin particles thus obtained was $8\mu10^4$, and the Tg thereof was 40° C.

Dispersion Stabilizing Resin (PS-4)

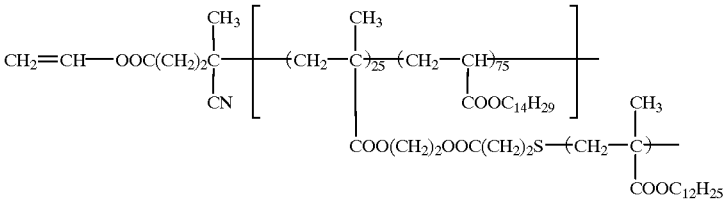

Mw: $4\times10^4$ (composition ratio: by weight)

EXAMPLE II-1

Preparation of Lithographic Printing Plate Precursor

Coating Composition for Image-Receiving Layer

To 143 g of a 7% by weight aqueous solution of polyvinyl alcohol (PVA-405 produced by Kuraray Co., Ltd.) was added 57 g of methanol with stirring and the mixture was further stirred for 30 minutes. To the mixture was added 10 g of tetramethoxysilane, followed by stirring for 30 minutes, then one ml of concentrated hydrochloric acid was added thereto and the mixture was stirred for 2 hours and further allowed to stand for 24 hours.

To the resulting mixture were added 100 g of a 40% solution of photocatalyst titanium oxide sol (Titanium oxide slurry STS-21 produced by Ishihara Sangyo Kaisha Ltd.) and 48 g of a 20% solution of Alumina Sol 520 (produced by Nissan Chemical Industries, Ltd.) and the mixture was stirred for 20 minutes to prepare a dispersion.

A support of ELP-1X Type Master (trade name, produced by Fuji Photo Film Co., Ltd.) having the Bekk smoothness of 900 (sec/10 ml) on the under layer side, which is used as an electrophotographic lithographic printing plate precursor for small-scale commercial printing, was employed. On the support, the coating composition prepared above was coated by means of a wire bar and dried at 110° C. for 20 minutes to form an image-receiving layer having a coating amount of 5 g/m$^2$. Thus, a lithographic printing plate precursor was prepared.

The Bekk smoothness of the surface of the printing plate precursor was 800 (sec/10 ml), which was measured using a Bekk smoothness tester (produced by Kumagai Riko Co., Ltd.) under a condition that the air volume was 10 ml as described hereinbefore.

Further, 2 $\mu$l of distilled water was put on the surface of the printing plate precursor, and after a 30-second lapse the contact angle of the water with the printing plate precursor surface was measured with a surface contact angle meter (CA-D, trade name, produced by Kyowa Kaimen Kagaku Co., Ltd.) as described hereinbefore. The measured value was 50 degrees.

A servo plotter (DA 8400, produced by Graphtec Corp.) able to write in accordance with an output of a personal computer was converted so that a pen plotter section was loaded with an ink ejection head shown in FIG. 2 and a counter electrode was disposed at a distance of 1.5 mm. On the counter electrode was mounted the lithographic printing plate precursor prepared above, and printing was carried out on the printing plate precursor with Oil-Based Ink (IK-1) shown below to make a plate. During the plate making, the under layer provided just under the image-receiving layer of the printing plate precursor was connected electrically to the counter electrode by silver paste. Then, the printing plate precursor as heated by means of a Ricoh Fuser (produced by Ricoh Company Ltd.) so as to control the surface temperature of the precursor to 70° C. for 10 seconds, thereby fixing the ink images.

Oil-Based Ink (IK-1)

In a paint shaker (produced by Toyo Seiki K.K.), 10 g of a copolymer of dodecyl methacrylate and acrylic acid (copolymerization ratio: 95/5 by weight), 10 g of nigrosine and 30 g of Isopar G were placed together with glass beads, and the mixture was dispersed for 4 hours to prepare a fine dispersion of nigrosine.

A mixture of 20 g (as a solid basis) of Resin Particles (PL-1) prepared in Preparation Example 1, 7.5 g of the above described dispersion of nigrosine and 0.08 g of a copolymer of octadecene and maleic acid monooctadecylamide was diluted with one liter of Isopar E, thereby preparing oil-based black ink.

The images formed on the printing plate precursor were observed under an optical microscope of 200 magnifications, and the image quality was evaluated. As a result, the images were clear free from blurs or disappearance of fine lines and fine letters.

Then, the printing plate precursor was exposed to light for 3 minutes by means of a 100 W high-pressure mercury lamp placed in a distance of 20 cm.

The surface wettability of the non-image area and that of the image area (solid image area) of the thus obtained lithographic printing plate were evaluated by the contact angle with water. The contact angle of water with the surface of the non-image area was changed to 0 degree, and that of the image area was 90 degrees.

Then, the lithographic printing plate was mounted in a printing machine (Oliver Model 94, produced by Sakurai Seisakusho K.K.), and printing was performed on printing papers via the lithographic printing plate using black ink for offset printing and dampening water prepared by diluting SLM-OD (produced by Mitsubishi Paper Mills, Ltd.) 100 times with distilled water and placed in a dampening saucer.

The 10th printed matter was picked in the course of printing, and the images thereon were evaluated by visual observation using a magnifier of 20 magnifications. The observation result indicated that the non-image area was free from background stains due to adhesion of the printing ink and the uniformity of the solid image area was highly satisfactory. Further, the printed matter was observed under an optical microscope of 200 magnifications. According to the observation, neither sharpening nor disappearance were found in the areas of fine lines and fine letters, and the image quality was excellent.

As a result of printing, more than 3,000 sheets of printed matter having image quality equal to that of the 10th printed matter were obtained.

EXAMPLES II-2

Preparation of Water-Resistant Support

Wood free paper having a basis weight of 100 g/m$^2$ was used as a substrate, and the coating composition for a backcoat layer shown below was coated on one side of the substrate by means of a wire bar to form a backcoat layer having a dry coating amount of 12 g/m$^2$. Then, the backcoat layer was subjected to a calender treatment so as to have the Bekk smoothness of about 500 (sec/10 ml).

Coating Composition for Backcoat Layer

| | |
|---|---|
| Kaolin (50% aqueous dispersion) | 200 parts |
| Polyvinyl alcohol (10% aqueous solution) | 60 parts |
| SBR latex (solid content: 59%, Tg: 0° C.) | 100 parts |
| Melamine resin (solid content: 80%, Sumirez Resin SR-613) | 5 parts |

On the other side of the substrate, the coating composition for an under layer, which had one of the formulae II-A to II-G shown in Table II-1 below, was coated by means of a wire bar to form an under layer having a dry coating amount of 10 g/m$^2$. Then, the under layer was subjected to a calender treatment so as to have the Bekk smoothness of about 1,500 (sec/10 ml). The thus prepared seven samples of water-resistant support were referred to as support samples No. 11 to No. 17 corresponding to the composition formulae II-A to II-G respectively, as shown in Table II-1.

TABLE II-1

| Formula | Composition | | | | Support Sample No. |
|---|---|---|---|---|---|
| | Carbon Black | Clay | SBR Latex | Melamine Resin | |
| II-A | 0 | 60 | 36 | 4 | 11 |
| II-B | 3 | 57 | 36 | 4 | 12 |
| II-C | 5.4 | 54.6 | 36 | 4 | 13 |
| II-D | 7.2 | 52.8 | 36 | 4 | 14 |
| II-E | 9 | 51 | 36 | 4 | 15 |
| II-F | 15 | 45 | 36 | 4 | 16 |
| II-G | 30 | 30 | 36 | 4 | 17 |

The figures in the above table are the solid contents of ingredients, expressed in % by weight, in each composition.

Coating Composition for Under Layer

Carbon black (30% aqueous dispersion)

Clay (50% aqueous dispersion)

SBR latex (solid content: 50%, Tg: 25° C.)

Melamine resin (solid content: 80%, Sumirez Resin SR-613)

Each set of ingredients were mixed in accordance with its corresponding formula shown in Table II-1, and further admixed with water so as to have a total solid concentration of 25%. Thus, the coating compositions II-A to II-G for the under layer were obtained.

The measurement of specific electric resistance of each under layer was carried out in the following manner.

Each of the coating compositions II-A to II-G was applied to a thoroughly degreased and cleaned stainless steel plate at a dry coating amount of 10 g/m$^2$ to form a coating film. The thus formed seven samples of coating films were each examined for specific electric resistance in accordance with a three-terminal method with a guard electrode according to the method described in JIS K-6911. The results are shown in Table II-2.

TABLE II-2

| Under Layer | Specific Electric Resistance (Ω · cm) |
|---|---|
| II-A | $2 \times 10^{12}$ |
| II-B | $1 \times 10^{11}$ |
| II-C | $4 \times 10^{9}$ |
| II-D | $1 \times 10^{8}$ |
| II-E | $7 \times 10^{4}$ |
| II-F | $5 \times 10^{3}$ |
| II-G | $4 \times 10^{3}$ |

Preparation of Lithographic Printing Plate Precursors

The dispersion having the composition shown below was coated on each of the support samples No. 11 to No. 17 at a dry coating amount of 5 g/m$^2$ to form an image-receiving layer, thereby preparing lithographic printing plate precursors. Each printing plate precursor surface had the Bekk smoothness of 700 to 800 (sec/10 ml) and the contact angle of water therewith was 50 degrees.

Coating Composition for Image-Receiving Layer

The following composition was placed together with glass beads in a paint shaker (produced by Toyo Seiki K.K.), and dispersed for 10 minutes. Thereafter, the glass beads were removed by filtration and a dispersion was obtained.

| | |
|---|---|
| Photocatalyst titanium oxide powder (ST-01 produced by Ishihara Sangyo Kaisha Ltd.) | 45 g |
| Colloidal silica (20% solution, Snowtex C produced by Nissan Chemical Industries, Ltd.) | 25 g |
| Complex for binder resin shown below | 138.5 g |
| Water | 250 g |

Complex for binder resin:

To 100 g of a 10% by weight aqueous solution of succinic acid-modified starch (PENON-F3 produced by Nichiden Chemical Co., Ltd.) was added 28.5 g of methanol and the mixture was stirred for 30 minutes. To the mixture was added 10 g of tetraethoxysilane, followed by stirring for 30 minutes, then one ml of concentrated hydrochloric acid was added thereto and the mixture was stirred for 6 hours and further allowed to stand for 24 hours.

The image formation was performed on each of the thus prepared lithographic printing plate precursor Specimen Nos. II-11 to II-17 using Oil-Based Ink (IK-1) in the same manner as in Example II-1, and the ink images were fixed in the same manner as in Example II-1. During the image formation, the under layer provided just under the image-receiving layer of the printing plate precursor was connected electrically to the counter electrode by silver paste.

Subsequently, each printing plate precursor was irradiated with ultraviolet light for 3 minutes with the same light source as used in Example II-1 which was placed in a distance of 20 cm. Thus, lithographic printing plates samples were obtained.

The contact angles of water with the non-image area and the image area of each lithographic printing plate were 0 degree and 70 degrees respectively.

Then, each of the lithographic printing plates was mounted in an automatic printing machine (AM-2850, trade name, produced by AM Co. Ltd.), and printing was performed using black ink for offset printing and dampening water prepared by diluting SLM-OD 50 times with distilled water and placed in a dampening saucer.

Each of the lithographic printing plates was examined for image quality of printing plate, image quality of printed matter therefrom and press life. The following criteria were employed for evaluating those qualities.

1) Image quality of printing plate:

The images of each lithographic printing plate were observed using an optical microscope of 200 magnifications, and the image quality was evaluated. The capital letters E, G and B in Table II-3 below represent the following states, respectively.

E: The images are very clear, and even fine lines and fine letters have excellent quality.

G: The images are clear, and even fine lines and fine letters have good quality.

B: There are disappearance and blurs in the areas of fine lines and fine letters, so the image quality is bad.

2) Image quality of printed matter:

The quality of images on each printed matter obtained from each lithographic printing plate was evaluated in the same manner as in the above item 1). The capital letters E, G and B in Table II-3 represent that the printed matters are in the same states as described above, respectively.

3) Press life:

The press life is expressed in terms of the number of printed matter obtained until background stains or disappearance of image was visually observed on the printed matter.

The results are shown in Table II-3 below.

TABLE II-3

| Specimen No. | Support Sample | Image Quality of Printing Plate | Image Quality of Printed Matter | Press Life |
|---|---|---|---|---|
| II-11 | No. 11 | B | B | 50 |
| II-12 | No. 12 | B | B | 100 |
| II-13 | No. 13 | G | G | 1,500 |
| II-14 | No. 14 | E | E | 3,000 |
| II-15 | No. 15 | E | E | 3,000 |
| II-16 | No. 16 | E | E | 3,000 |
| II-17 | No. 17 | E | E | 3,000 |

The results shown in Table II-3 are considered in some detail with reference to the values of specific electric resistance shown in Table II-2.

In Specimen Nos. II-13 to II-17, the under layer of each support had a low specific electric resistance, specifically not more than $10^{10}$ Ω·cm. The images formed were clear, even the fine lines and fine letters had good quality, and the press life was good.

On the other hand, in Specimen Nos. II-11 and II-12, the under layer had specific electric resistance of higher than $10^{11}$ QΩ·cm. In these specimen, disappearance or blurs of image were observed. In addition, as the result of the blurs, the resin layer in the image area became thin, resulting in lowering the press life.

In other words, the results obtained indicate that the image quality of printing plate and the image quality of printed matter are better as the conductivity of the under layer provided just under the image-receiving layer is higher.

EXAMPLE II-3

Preparation of Lithographic Printing Plate Precursor

Coating Composition for Image-receiving Layer

The following composition was placed together with glass beads in a paint shaker (produced by Toyo Seiki K.K.) and dispersed for 5 minutes. Then, the glass beads were removed by filtration to obtain a dispersion.

| | |
|---|---|
| 30% Aqueous solution of photocatalyst titanium oxide sol (STS-02 produced by Ishihara Sangyo Kaisha Ltd.) | 150 g |
| Colloidal silica (Snowtex C) | 25 g |
| Complex for binder resin shown below | whole amount |

Complex for binder resin:

To a mixture of 120 g of a 10% aqueous solution of polyethylene glycol 20000(produced by Wako Pure Chemical Industries, Ltd.) and 30 g of methanol were added with stirring 6 g of tetraethoxysilane and 2 g of methyltrimethoxysilane, followed by stirring for 30 minutes, then one ml of concentrated hydrochloric acid was added thereto and the mixture was stirred for 4 hours and further allowed to stand overnight.

On the same water-resistant support as Support Sample No. 17 used in Example II-2, the coating composition described above was coated by means of a wire bar and dried at 100° C. for 10 minutes to form an image-receiving layer having a coating amount of 5 g/m$^2$. Thus, a lithographic printing plate precursor was prepared. The Bekk smoothness of the surface of the image-receiving layer was 850 (sec/10 ml) and the contact angle with water thereof was 65 degrees.

The printing plate precursor was subjected to the image formation, fixing and irradiation with ultraviolet light in the same manner as in Example II-1 except for using Oil-Based Ink (IK-2) having the composition shown below in place of Oil-Based Ink (IK-1) to prepare a lithographic printing plate and the offset printing was conducted in the same manner as in Example II-1.

Preparation of Oil-Based Ink (IK-2)

In a paint shaker (produced by Toyo Seiki K.K.), 10 g of a copolymer of dodecyl methacrylate and methacrylic acid (copolymerization ratio: 95/5 by weight), 10 g of Alkali Blue and 30 g of Isopar G were placed together with glass beads, and the mixture was dispersed for 4 hours to prepare a fine dispersion of Alkali Blue.

A mixture of 45 g (as a solid basis) of Resin Particles (PL-2) prepared in Preparation Example 2, 18 g of the above described dispersion of Alkali Blue and 0.16 g of a copolymer of octyl vinyl ether and maleic acid monooctadecylamide was diluted with one liter of Isopar G to prepare oil-based blue ink.

The printed matter obtained had clear images without background stains similar to those obtained in Example I-1, and press life was good as more than 3,000.

EXAMPLE II-4

Preparation of Lithographic Printing Plate Precursor

Coating Composition for Image-receiving Layer

The following composition was dispersed using a homogenizer(produced by Nippon Seiki K.K.) at a rotation of 10,000 r.p.m. for 30 minutes to obtain a dispersion.

| | |
|---|---|
| Photocatalyst titanium oxide powder (ST-21) | 50 g |
| Polyamine (Epomin SPO12 produced by Nippon Shokubai Co., Ltd.) | 0.8 g |
| Complex for binder resin shown below | whole amount |
| Water | 250 g |

Complex for binder resin:

To a mixture of 40 g of a 15% aqueous solution of polyethylene glycol having epoxy groups at both terminals thereof (Epolight 400E produced by Kyoeisha Chemical Co., Ltd.) and 60 g of methanol were added 10 g of methyltrimethoxysilane, followed by stirring for 30 minutes, then 2 ml of 1N hydrochloric acid was added thereto and the mixture was stirred for one hour and further allowed to stand for 6 hours.

On the same water-resistant support as Support Sample No. 14 used in Example II-2, the coating composition described above was coated by means of a wire bar and dried to form an image-receiving layer having a coating amount of 5 g/m$^2$. Thus, a lithographic printing plate precursor was prepared. The Bekk smoothness of the surface of the image-receiving layer was 650 (sec/10 ml) and the contact angle with water thereof was 85 degrees.

The printing plate precursor was subjected to the image formation and fixing in the same manner as in Example II-1 except for using Oil-Based Ink (IK-3) having the composition shown below in place of Oil-Based Ink (IK-1).

Preparation of Oil-Based Ink (IK-3)

A mixture of 300 g of the white dispersion of Resin Particles (PL-4) prepared in Preparation Example 4 and 5 g of Victoria Blue B was heated to a temperature of 100° C. and stirred with heating for 4 hours. After cooling to room temperature, the mixture was passed through a 200-mesh nylon cloth to remove the residual dye, thereby obtaining a blue resin dispersion having an average particle diameter of 0.47 μm.

A mixture of 260 g of the above described blue resin dispersion and 0.07 g of zirconium naphthenate was diluted with one liter of Shellsol 71 to prepare oil-based blue ink.

The printing plate precursor bearing the images was all over exposed to light for 5 minutes by means of a 150 W xenon lump placed in a distance of 10 cm to prepare a lithographic printing plate. The contact angle with water of the surface of the non-image area was 0 degree and that of the image area was 88 degrees.

Using the printing plate, the offset printing was conducted in the same manner as in Example II-1.

The printed matter obtained had clear images without background stains similar to those obtained in Example II-1, and press life was good as more than 3,000.

EXAMPLE II-5

Preparation of Lithographic Printing Plate Precursor

Coating Composition for Image-receiving Layer

The following composition was placed together with glass beads in a paint shaker (produced by Toyo Seiki K.K.) and dispersed for 10 minutes. Then, the glass beads were removed by filtration to obtain a dispersion.

| | |
|---|---|
| Photocatalyst titanium oxide powder (ST-01) | 45 g |
| 20% Solution of Alumina sol 520 | 25 g |
| Complex for binder resin shown below | whole amount |
| Water | 230 g |

Complex for binder resin:

To 50 g of a 10% tetrahydrofuran solution of poly(N-butanoylethyleneimine) was added 30 g of methanol and the mixture stirred for 10 minutes. To the mixture were added 5 g of methyltrimethoxysilane and 2.5 g of 3-sulfopropyltrimethoxysilane, followed by stirring for 30 minutes, then 3 ml of 1N hydrochloric acid was added thereto and the mixture was stirred for 4 hours and further allowed to stand for 24 hours.

The coating composition described above was coated on a degreased aluminum plate having a thickness of 150 $\mu$m by means of a wire bar and dried at 110° C. for 20 minutes to form an image-receiving layer having a coating amount of 3 g/m$^2$. Thus, a lithographic printing plate precursor was prepared. The Bekk smoothness of the surface of the image-receiving layer was 900 (sec/10 ml) and the contact angle with water thereof was 70 degrees.

The printing plate precursor was subjected to the image formation, fixing and irradiation with ultraviolet light in the same manner as in Example II-1 to prepare a lithographic printing plate and the offset printing was conducted in the same manner as in Example II-1 except for using Oil-Based Ink (IK-4) having the composition shown below in place of Oil-Based Ink (IK-1).

Preparation of Oil-Based Ink (IK-4)

A mixture of 500 g of the white dispersion of Resin Particles (PL-3) prepared in Preparation Example 3 and 7.5 g of Sumikaron Black was heated to a temperature of 100° C. and stirred with heating for 6 hours. After cooling to room temperature, the mixture was passed through a 200-mesh nylon cloth to remove the residual dye, thereby obtaining a black resin dispersion having an average particle diameter of 0.40 $\mu$m.

A mixture of 135 g of the above described black resin dispersion and 0.07 g of a copolymer of octadecyl vinyl ether and maleic acid monododecylamide was diluted with one liter of Isopar E to prepare oil-based black ink.

The printed matter obtained had clear images without background stains similar to those obtained in Example II-1, and press life was good as more than 10,000.

EXAMPLES II-6 TO II-12

Preparation of Lithographic Printing Plate Precursor

Each lithographic printing plate precursor was prepared in the same manner as in Example II-1 except for using each compound shown in Table II-4 below in place of the polyvinyl alcohol (PVA-405) and tetramethoxysilane employed for forming the complex for binder resin in Example II-1.

The printing plate precursors were subjected to the image formation, fixing and irradiation with ultraviolet light in the same manner as in Example II-1 to prepare lithographic printing plates and the offset printing was conducted in the same manner as in Example II-1.

The printed matter obtained had clear images without background stains similar to those obtained in Example II-1, and press life was good as more than 3,000.

TABLE II-4

| Example | Organic Polymer | Organometallic Compound (weight ratio) | Contact Angle of Image-Receiving Layer | Contact Angle of Non-Image Area after Irradiation | Contact Angle of Image Area |
|---|---|---|---|---|---|
| II-6 | Polyvinylpyrrolidone | Methyltrimethoxysilane (60%) Tetraethoxysilane (40%) | 65 degrees | 15 degrees or less | 86 degrees |
| II-7 | Propyleneoxide-modified starch (PENON HV-2 produced by Nichiden Chemical Co., Ltd.) | Tetra(2-methoxyethoxy)titanium | 75 degrees | 15 degrees or less | 65 degrees |
| II-8 | Polyvinyl alcohol (saponification degree: 60%) | Zirconium tetra-n-propoxide | 70 degrees | 15 degrees or less | 86 degrees |
| II-9 | N-Methylacrylamide/methyl acrylate (70/30 in weight ratio) copolymer | γ-Mercaptopropyltrimethoxysilane (20%) Tetraethoxysilane (80%) | 85 degrees | 15 degrees or less | 88 degrees |
| II-10 | Gelatin | Ethyltrimethoxysilane (50%) Methyltriethoxysilane (50%) | 75 degrees | 15 degrees or less | 85 degrees |
| II-11 | Hydroxypropylated starch (PENON LD-1 produced by Nichiden Chemical Co., Ltd.) | Allyltris(β-methoxyethoxy)silane | 65 degrees | 15 degrees or less | 87 degrees |
| II-12 | Polyvinyl alcohol (saponification degree: 66%) | Trimethoxysilane (75%) Tetramethoxysilane (25%) | 55 degrees | 15 degrees or less | 84 degrees |

While the invention has been described in detail and with reference to specific embodiments thereof, it will be apparent to one skilled in the art that various changes and modifications can be made therein without departing from the spirit and scope thereof.

What is claimed is:

1. A lithographic printing plate precursor comprising a water-resistant support having provided thereon an image-receiving layer, wherein the image-receiving layer comprises anatase-type titanium oxide grains and a binder resin comprising a complex composed of an organometallic polymer and an organic polymer containing at least one member selected from the group consisting of an amido bond, a urethane bond, a ureido bond and a hydroxy group, the surface of the image-receiving layer has a contact angle with water of at least 25 degrees and the contact angle with water thereof is reduced to 15 degrees or below when it is irradiated with ultraviolet light.

2. The lithographic printing plate precursor as claimed in claim 1, wherein the image-receiving layer has a surface smoothness of at least 30 seconds/10 ml measured in the term of a Bekk smoothness.

3. The lithographic printing plate precursor as claimed in claim 1, wherein the organometallic polymer is a polymer formed by a hydrolysis polymerization condensation reaction of at least one organometallic compound represented by the following formula (I):

$$(R^0)_n M(Y)_{x-n} \quad (I)$$

wherein $R^0$ represents a hydrogen atom, a hydrocarbon group or a heterocyclic group; Y represents a reactive group; M represents a metallic atom having from 3 to 6 valences; x represents a valence of the metallic atom M; and n represents 0, 1, 2, 3 or 4, provided that the balance of x−n is not less than 2.

4. The lithographic printing plate precursor as claimed in claim 1, which is a printing plate precursor for forming an image with an electrophotographic recording system.

5. The lithographic printing plate precursor as claimed in claim 1, which is a printing plate precursor for forming an image with an ink jet recording system.

6. The lithographic printing plate precursor as claimed in claim 1, wherein a content of the anatase-type titanium oxide grains is from 30 to 90% by weight in the image-receiving layer.

7. The lithographic printing plate precursor as claimed in claim 1, wherein the organic polymer is an amide resin having the —N($R^{10}$)CO— or —N($R^{10}$)$SO_2$— bond wherein $R^{10}$ represents a hydrogen atom, a hydrocarbon group or a heterocyclic group, a ureido resin having the —NHCONH— bond, or a urethane resin having the —NHCOO— bond.

8. The lithographic printing plate precursor as claimed in claim 1, wherein the organic polymer is a polymer containing a repeating unit represented by the following formula (II):

(II)

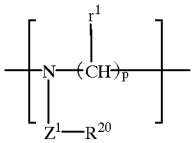

wherein, $Z^1$ represents —CO— or —CS—; $R^{20}$ represents a hydrogen atom, a hydrocarbon group or a heterocyclic group; $r^1$ represents a hydrogen atom or an alkyl group having from 1 to 6 carbon atoms, $r^1$s may be the same or different; and p represents an integer of 2 or 3.

9. The lithographic printing plate precursor as claimed in claim 1, wherein a weight ratio of the organo-metallic polymer/organic polymer is from 10/90 to 90/10.

10. A method for preparing a lithographic printing plate comprising forming a colored toner image on an image-receiving layer of a lithographic printing plate precursor which comprises a water-resistant support having provided thereon the image-receiving layer comprising anatase-type titanium oxide grains and a binder resin comprising a complex composed of an organometallic polymer and an organic polymer containing at least one member selected from the group consisting of an amido bond, a urethane bond, a ureido bond and a hydroxy group by utilizing an electrophotographic recording system and then irradiating the whole surface of the image-receiving layer with ultraviolet light to change the non-image area to a hydrophilic surface which does not receive printing ink.

11. The method for preparing a lithographic printing plate as claimed in claim 10, wherein the image formation utilizing the electrophotographic recording system is carried out with a liquid developer.

12. The method for preparing a lithographic printing plate as claimed in claim 10, wherein the water-resistant support has a specific electric resistance of from $10^4$ to $10^{13}$ Ω·cm at least in the part just under the image-receiving layer.

13. A method for preparing a lithographic printing plate comprising forming a colored image on an image-receiving layer of a lithographic printing plate precursor which comprises a water-resistant support having provided thereon the image-receiving layer comprising anatase-type titanium oxide grains and a binder resin comprising a complex composed of an organometallic polymer and an organic polymer containing at least one member selected from the group consisting of an amido bond, a urethane bond, a ureido bond and a hydroxy group by utilizing an ink jet recording system and then irradiating the whole surface of the image-receiving layer with ultraviolet light to change the non-image area to a hydrophilic surface which does not receive printing ink.

14. The method for preparing a lithographic printing plate as claimed in claim 13, wherein the image formation utilizing the ink jet recording is carried out by ejecting dropwise oil-based ink.

15. The method for preparing a lithographic printing plate as claimed in claim 14, wherein the oil-based ink comprises a nonaqueous solvent having an electric resistance of $10^9$ Ω·cm or more and a dielectric constant of 3.5 or below and colored or colorless hydrophobic resin particles dispersed therein which are solid at temperature of 35° C. or below and further colored particles when the resin particles are colorless.

16. The method for preparing a lithographic printing plate as claimed in claim 15, wherein the particles dispersed in the oil-based ink are positively or negatively charged particles and the oil-based ink is ejected utilizing an electrostatic field.

17. The method for preparing a lithographic printing plate as claimed in claim 14, wherein the water-resistant support has a specific electric resistance of not more than $10^{10}$ Ω·cm at least in the part just under the image-receiving layer.

* * * * *